US010745158B2

(12) United States Patent
Sikora et al.

(10) Patent No.: US 10,745,158 B2
(45) Date of Patent: Aug. 18, 2020

(54) STRAPPING TENSIONING AND SEALING TOOL

(71) Applicant: Golden Bear LLC, Columbus, OH (US)

(72) Inventors: Joshua Robert Sikora, Columbus, OH (US); Stephen William Sikora, Columbus, OH (US); Charles Russell Patzer, Columbus, OH (US); Jack Louis Kime, Columbus, OH (US)

(73) Assignee: Golden Bear LLC, Columbus, OH (US)

( * ) Notice: Subject to any disclaimer, the term of this patent is extended or adjusted under 35 U.S.C. 154(b) by 310 days.

(21) Appl. No.: 15/804,415

(22) Filed: Nov. 6, 2017

(65) Prior Publication Data

US 2018/0127124 A1 May 10, 2018

Related U.S. Application Data

(60) Provisional application No. 62/418,214, filed on Nov. 6, 2016.

(51) Int. Cl.

| | |
|---|---|
| ***B65B 13/22*** | (2006.01) |
| ***B65B 61/06*** | (2006.01) |
| ***B65B 57/02*** | (2006.01) |
| ***B65B 13/18*** | (2006.01) |
| ***B65B 57/00*** | (2006.01) |
| ***B65B 13/34*** | (2006.01) |
| *B65B 13/30* | (2006.01) |

(52) U.S. Cl.

CPC ..... *B65B 13/22* (2013.01); *B65B 13/188* (2013.01); *B65B 13/345* (2013.01); *B65B 57/00* (2013.01); *B65B 57/02* (2013.01); *B65B 61/06* (2013.01); *B65B 13/305* (2013.01)

(58) Field of Classification Search

CPC ..... B21F 11/00; B21F 1/026; B65B 13/22; B65B 13/022; B65B 13/02; B65B 13/345; B65B 13/34

USPC ..... 140/150–154; 100/29–33 R

See application file for complete search history.

(56) References Cited

U.S. PATENT DOCUMENTS 2,386,153 A 10/1945 Watt et al.
3,144,888 A 8/1964 Palmer (Continued)

OTHER PUBLICATIONS

PCT Form 210, International Search Report for PCT/US2019/019044, dated May 7, 2019.

(Continued)

*Primary Examiner* — Pradeep C Battula

(74) *Attorney, Agent, or Firm* — The Law Office of Patrick F. O'Reilly, III, LLC

(57) ABSTRACT

A strapping tensioning and sealing tool is disclosed herein. In one or more embodiments, the strapping tensioning and sealing tool includes a tensioning assembly, the tensioning assembly configured to apply tension to a piece of strapping; and a sealing assembly, the sealing assembly comprising at least one cam member, at least one crimping jaw member, and a motive power source, the at least one cam member operatively coupling the at least one crimping jaw member to the motive power source, and the at least one crimping jaw member of the sealing assembly configured to crimp a strapping sealing member so as to secure the piece of strapping around a package or bundle of items.

20 Claims, 17 Drawing Sheets

(56) References Cited

U.S. PATENT DOCUMENTS

| | | | | |
|---|---|---|---|---|
| 3,329,178 | A | 7/1967 | Plunkett | |
| 3,530,809 | A | 9/1970 | Porter | |
| 3,552,450 | A | 1/1971 | Plunkett | |
| 3,654,033 | A * | 4/1972 | Angarola | B65B 13/188 100/30 |
| 3,799,835 | A | 3/1974 | Gilmore | |
| 4,027,609 | A | 6/1977 | Kerr | |
| 4,096,019 | A | 6/1978 | Lehmann | |
| 4,166,422 | A | 9/1979 | Porter | |
| 4,412,498 | A | 11/1983 | Scholl | |
| 4,449,464 | A | 5/1984 | Porter | |
| 4,871,414 | A | 10/1989 | Niedrig | |
| 5,476,569 | A | 12/1995 | Harada | |
| 5,526,761 | A | 6/1996 | Mulcahey et al. | |
| 5,632,851 | A | 5/1997 | Young | |
| 5,653,095 | A | 8/1997 | Stamm | |
| 5,942,061 | A | 8/1999 | Figiel et al. | |
| 5,954,899 | A | 9/1999 | Figiel et al. | |
| 6,308,760 | B1 | 10/2001 | Finzo et al. | |
| 6,328,087 | B1 | 12/2001 | Finzo et al. | |
| 6,332,306 | B1 | 12/2001 | Finzo et al. | |
| 6,895,733 | B2 | 5/2005 | Nix | |
| 6,957,678 | B2 | 10/2005 | Scholl et al. | |
| 6,966,255 | B1 * | 11/2005 | Crittenden | B65B 13/22 100/29 |
| 7,073,431 | B1 | 7/2006 | Chen | |
| 7,428,866 | B2 | 9/2008 | Reiche | |
| 8,578,997 | B2 | 11/2013 | Rauch | |
| 9,789,984 | B2 | 10/2017 | Sikora et al. | |
| 2009/0013656 | A1 | 1/2009 | Nasiatka et al. | |
| 2011/0056392 | A1 | 3/2011 | Neeser et al. | |
| 2011/0083596 | A1 | 4/2011 | Asao et al. | |
| 2012/0060735 | A1 | 3/2012 | Dickerson | |
| 2012/0085274 | A1 | 4/2012 | Bardh et al. | |
| 2013/0085053 | A1 | 4/2013 | Figiel et al. | |
| 2014/0007781 | A1 * | 1/2014 | Sikora | B65B 13/22 100/29 |
| 2014/0290179 | A1 | 10/2014 | Keller | |
| 2015/0210411 | A1 * | 7/2015 | Finzo | B65B 13/22 100/29 |
| 2015/0321777 | A1 * | 11/2015 | Nasiatka | B65B 13/30 140/152 |
| 2016/0016682 | A1 * | 1/2016 | Boss | B65B 13/22 100/4 |
| 2016/0167814 | A1 * | 6/2016 | Figiel | B65B 13/025 100/33 R |
| 2017/0008652 | A1 * | 1/2017 | Figiel | B65B 13/22 |
| 2018/0037347 | A1 | 2/2018 | Sikora et al. | |
| 2019/0256233 | A1 | 8/2019 | Sikora et al. | |

OTHER PUBLICATIONS

PCT Form 237, Written Opinion of the International Searching Authority for PCT/US2019/019044, dated May 7, 2019.

* cited by examiner

DETAIL "A"

DETAIL "B"

DETAIL "C"

Detail "A"

STRAPPING TENSIONING AND SEALING TOOL

CROSS-REFERENCE TO RELATED APPLICATIONS

This patent application claims priority to, and incorporates by reference in its entirety, U.S. Provisional Patent Application No. 62/418,214, entitled "Strapping Tensioning And Sealing Tool", filed on Nov. 6, 2016.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a strapping tensioning and sealing tool. More particularly, the invention relates to a strapping tensioning and sealing tool that is configured to apply tension to a piece of strapping, and to crimp a strapping sealing member that secures end portions of the piece of strapping to one another.

2. Background and Description of Related Art

Various tools are known in the packaging art for performing numerous functions related to the manipulation of strapping, which is commonly used as a closing mechanism for packages, and as a convenient means for easily attaching two objects to one another (e.g., attaching a box to a pallet). Some of these conventional tools are powered directly from a centralized system, such as a building electrical system or a central pneumatic system. Other conventional packaging tools have a power supply that is an integral part of the tool. Both of the aforementioned types of conventional packaging tools have numerous limitations and drawbacks. For example, conventional combination steel strapping tools are too heavy for normal people to use them alone. Also, these combination steel strapping tools are not light enough to have a person without a counterbalance effectively use them. In addition, conventional combination steel strapping tools utilize a vast array of intricate components, resulting in these tools being quite expensive.

Therefore, what is needed is a combination strapping tool that is sufficiently lightweight so as to enable a single person to use the tool for multiple strapping operations on steel strapping (e.g., tensioning and sealing). Moreover, there is a need for a strapping tool that is sufficiently lightweight so as to obviate the need for the use of a counterbalance when using the tool. Furthermore, there is a need for a strapping tool that utilizes a preassembled motive power source and associated control board in order to reduce the number of specialized custom components of the tool, thereby reducing its overall cost.

BRIEF SUMMARY OF EMBODIMENTS OF THE INVENTION

Accordingly, the present invention is directed to a strapping tool that substantially obviates one or more problems resulting from the limitations and deficiencies of the related art.

In accordance with one or more embodiments of the present invention, there is provided a strapping tool. The strapping tool includes a tensioning assembly, the tensioning assembly configured to apply tension to a piece of strapping; and a sealing assembly, the sealing assembly comprising at least one cam member, at least one crimping jaw member, and a motive power source, the at least one cam member operatively coupling the at least one crimping jaw member to the motive power source, and the at least one crimping jaw member of the sealing assembly configured to crimp a strapping sealing member so as to secure the piece of strapping around a package or bundle of items.

In a further embodiment of the present invention, the tensioning assembly comprises a tensioning wheel operatively coupled to an additional motive power source, the additional motive power source driving the tensioning wheel so as to apply tension to the piece of strapping.

In yet a further embodiment, the at least one cam member of the sealing assembly comprises a first cam member and a second cam member and the at least one crimping jaw member of the sealing assembly comprises a first pair of crimping jaw members and a second pair of crimping jaw members, each of the first and second cam members being operatively coupled to the motive power source, the first cam member being operatively coupled to the first pair of crimping jaw members so as to selectively activate the first pair of crimping jaw members, and the second cam member being operatively coupled to the second pair of crimping jaw members so as to selectively activate the second pair of crimping jaw members.

In still a further embodiment, the first pair of crimping jaw members are operatively coupled to the first cam member by a first plurality of crimp arm members, and the second pair of crimping jaw members are operatively coupled to the second cam member by a second plurality of crimp arm members.

In yet a further embodiment, the sealing assembly further comprises a resilient tubular member, the resilient tubular member configured to bias the first and second pluralities of crimp arm members in an upward position such that the first and second pluralities of crimp arm members are continually operatively coupled to the first and second cam members by means of an arm pin subassembly.

In still a further embodiment, the first cam member is independent from the second cam member.

In yet a further embodiment, the motive power source comprises one of: (i) a pneumatic motor, (ii) a battery-powered electric motor, and (iii) a liquid fuel-based motor.

In still a further embodiment, the first cam member is connected to the second cam member.

In yet a further embodiment, the motive power source comprises a battery-powered electric motor.

In still a further embodiment, the strapping tool does not require a counterbalance for a user to operate the strapping tool.

In yet a further embodiment, the motive power source of the sealing assembly comprises an electric motor, and wherein the strapping tool further comprises a control system operatively coupled to the electric motor of the sealing assembly, the control system configured to measure motor load by means of amperage integration for assessing whether the strapping seal member is correctly applied.

In still a further embodiment, the control system is configured to assess whether the strapping seal member is correctly applied by determining if the motor load is above or below predetermined upper and lower limit threshold values. In this further embodiment, when the control system determines that the motor load is between the predetermined upper and lower limit threshold values, the control system concludes that the strapping seal member is correctly applied; and conversely, when the control system determines that the motor load is above the predetermined upper threshold value or below the predetermined lower threshold value, the control system concludes that the strapping seal member is not correctly applied.

In yet a further embodiment, the control system further comprises a plurality of control buttons, a first one of the control buttons configured to control the operation of the tensioning assembly and a second one of the control buttons configured to control the operation of the sealing assembly.

In still a further embodiment, the control system further comprises a microcontroller configured to control one or more hardware timers, one or more microcontroller timers, or one or more other timers so as to operate a plurality of timer circuits.

In yet a further embodiment, the motive power source comprises a battery-powered drill that includes a drill control board, and wherein the strapping tool further comprises an additional control board operatively coupled to the drill control board, the additional control board configured to control the battery-powered drill via the drill control board so as to enable the battery-powered drill to perform strapping functions.

In still a further embodiment, the additional control board is further configured to receive feedback information from the drill control board of the battery-powered drill.

In yet a further embodiment, the internal components of the battery-powered drill are disposed within a customized housing that is particularly configured to accommodate the tensioning assembly and the sealing assembly.

In still a further embodiment, the tensioning assembly is connected to the sealing assembly by means of a hinge member such that the sealing assembly is configured to rotate relative to the tensioning assembly.

In yet a further embodiment, the sealing assembly further comprises a cutting blade for cutting the piece of strapping, and the at least one cam member of the sealing assembly comprises a first cam member and a second cam member, the cutting blade being operatively coupled to the second cam member by means of a cutting blade linkage member.

In still a further embodiment, the strapping tool further comprises a first battery-powered electric motor and a second battery-powered electric motor, the first battery-powered electric motor powering the tensioning assembly, and the second battery-powered electric motor forming the motive power source of the sealing assembly for powering the sealing assembly.

In yet a further embodiment, the first battery-powered electric motor is disposed generally perpendicular to the second battery-powered electric motor.

In still a further embodiment, the motive power source of the sealing assembly is additionally configured to provide power for the tensioning assembly.

In yet a further embodiment, the tensioning assembly comprises a tensioning wheel operatively coupled to an electric motor, and wherein the strapping tool further comprises a control system operatively coupled to the electric motor of the tensioning assembly, the control system configured to measure motor load by means of amperage integration for assessing the tension applied to the piece of strapping.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 9:
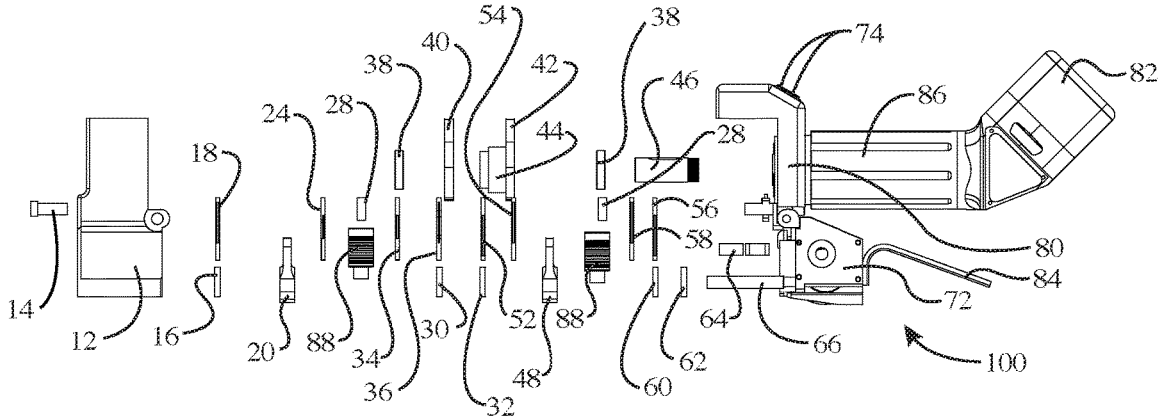
FIG. 9 is an exploded side elevational view of the strapping tensioning and sealing tool of FIG. 1.
Figure 10:
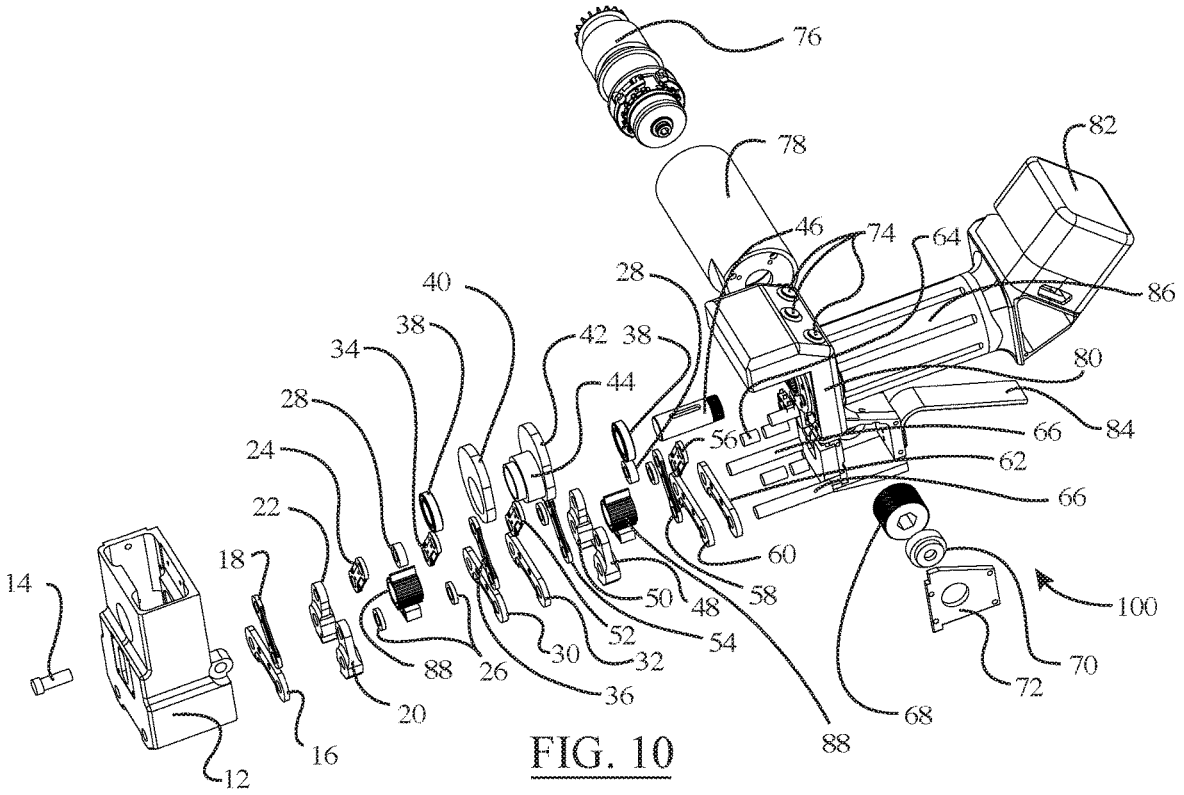
FIG. 10 is an exploded perspective view of the strapping tensioning and sealing tool of FIG. 1.
Figure 11:
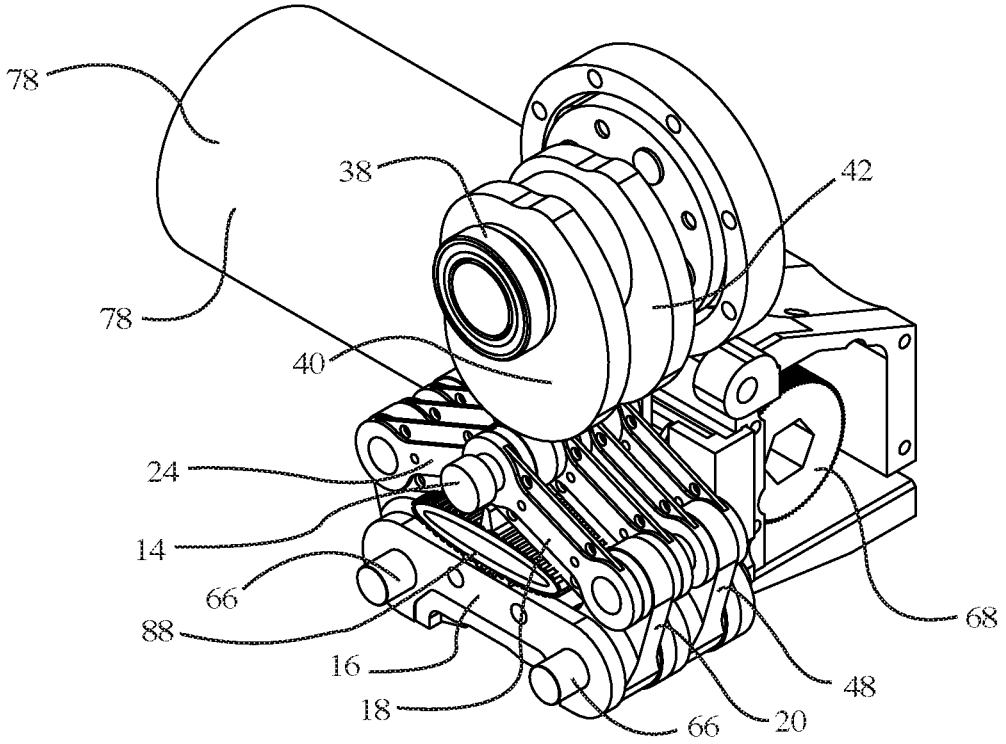
FIG. 11 is another perspective view illustrating the internal components of the tensioning and sealing assemblies of the strapping tensioning and sealing tool of FIG. 1, wherein the cam members of the sealing assembly are shown in the same aligned position such that the front and rear pairs of the crimping jaw members are disposed in the same crimping positions.
Figure 12:
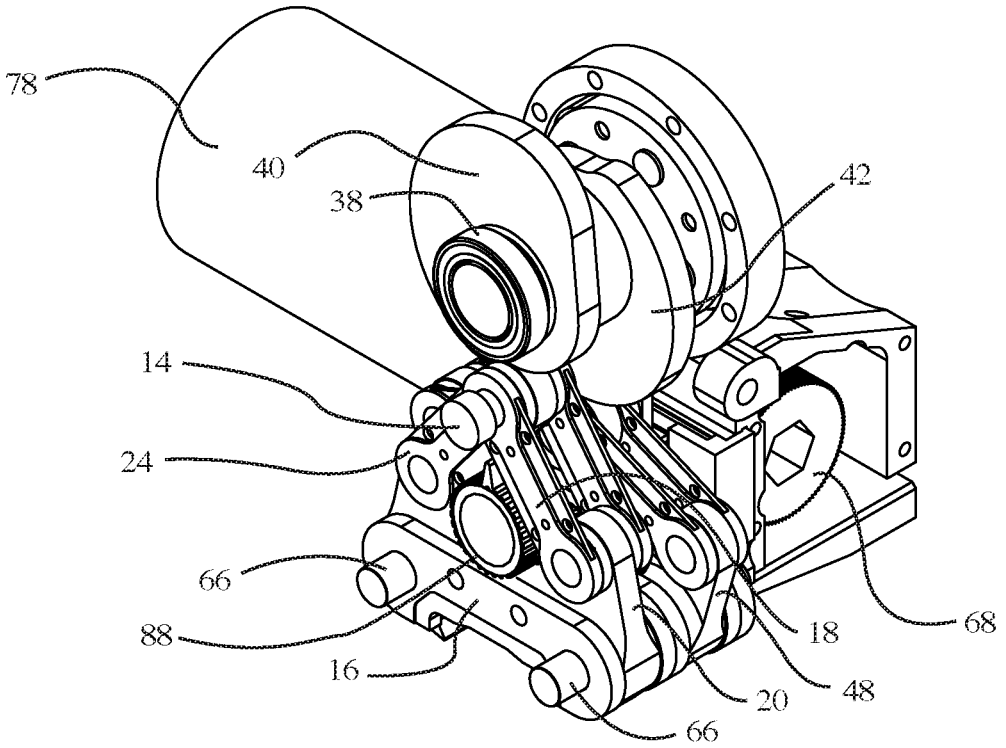
FIG. 12 is yet another perspective view illustrating the internal components of the tensioning and sealing assemblies of the strapping tensioning and sealing tool of FIG. 1, wherein the cam members of the sealing assembly are shown in different positions such that the front and rear pairs of the crimping jaw members are disposed in the different positions.
Figure 13:
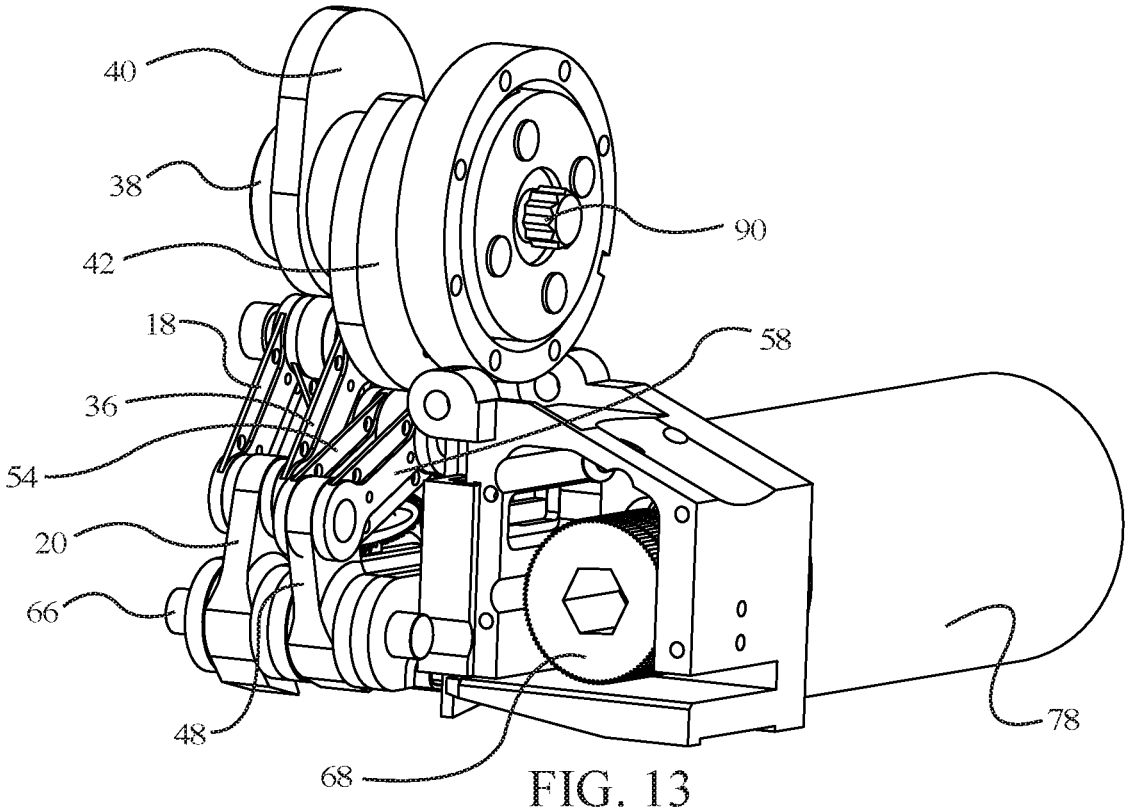
FIG. 13 is a side perspective view illustrating the internal components of the tensioning and sealing assemblies of the strapping tensioning and sealing tool of FIG. 1, wherein the rear pair of the crimping jaw members have been driven into crimped positions by the second cam member, while the front pair of the crimping jaw members are in uncrimped positions.
Figure 14:
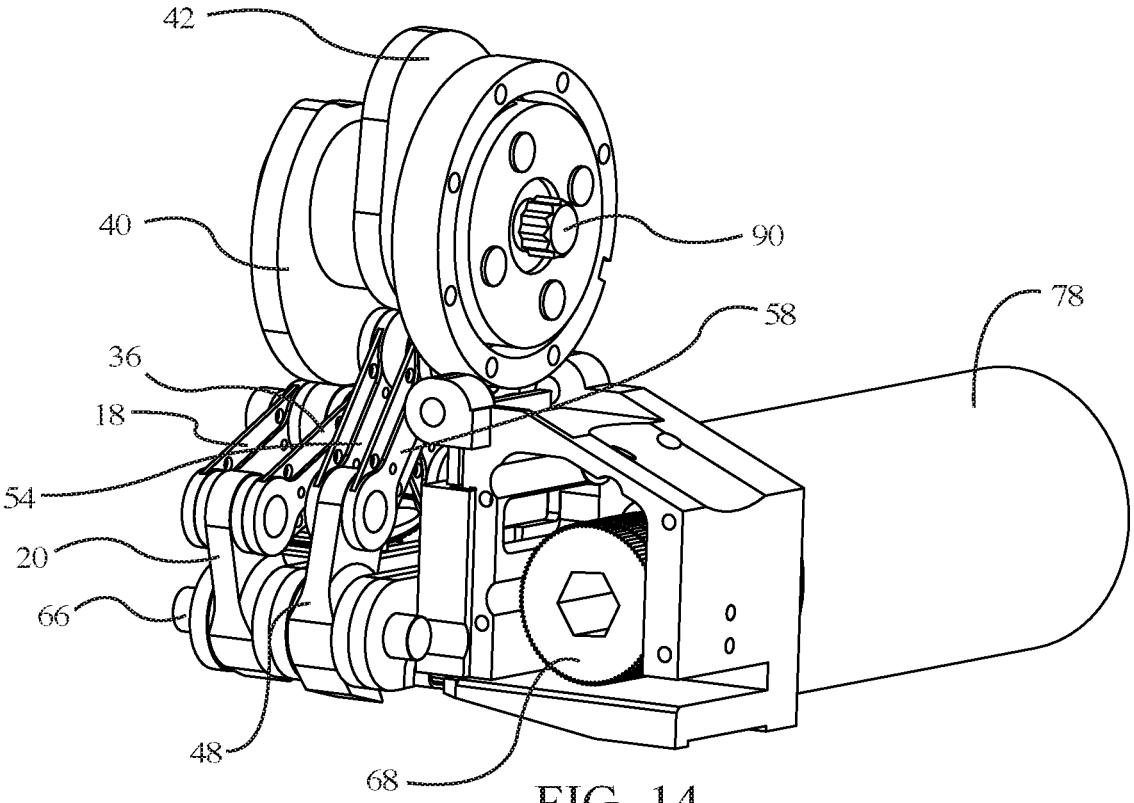
FIG. 14 is a side perspective view illustrating the internal components of the tensioning and sealing assemblies of the strapping tensioning and sealing tool of FIG. 1, wherein the front pair of the crimping jaw members have been driven into crimped positions by the first cam member, while the rear pair of the crimping jaw members are in uncrimped positions.
Figure 22:
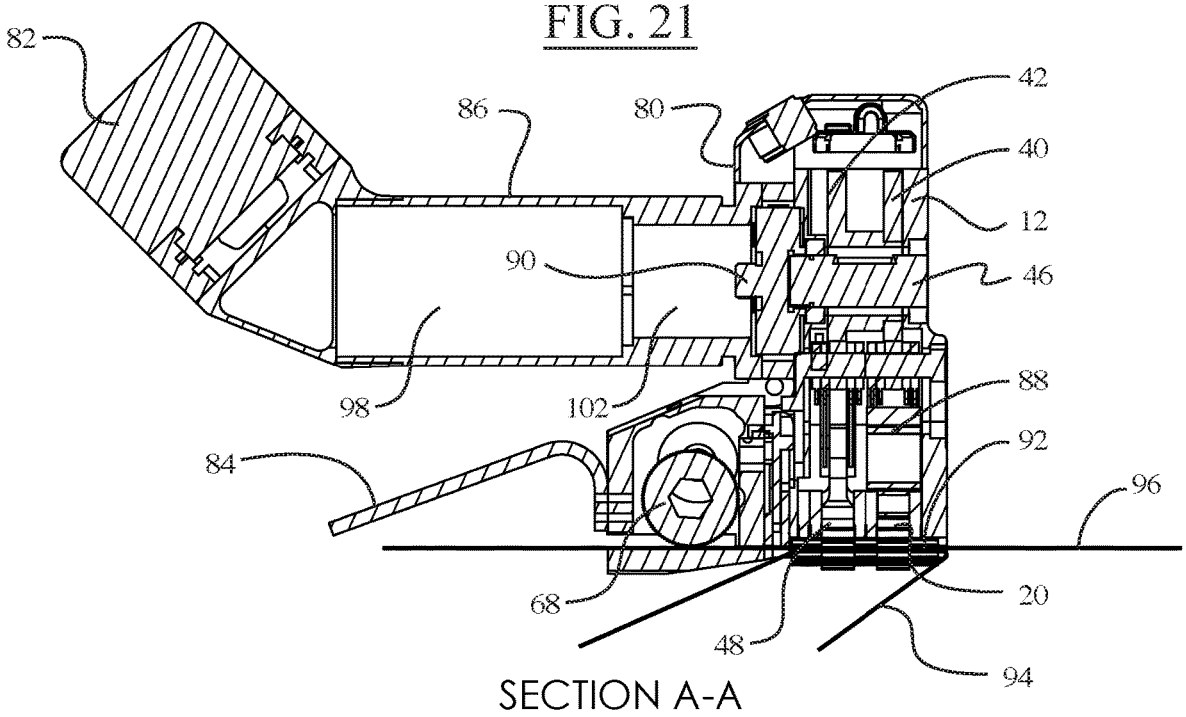
FIG. 22 is a longitudinal sectional view of the strapping tensioning and sealing tool and the strapping of FIG. 4, wherein the section is generally cut along the cutting-plane line A-A in FIG. 21.
Figure 23:
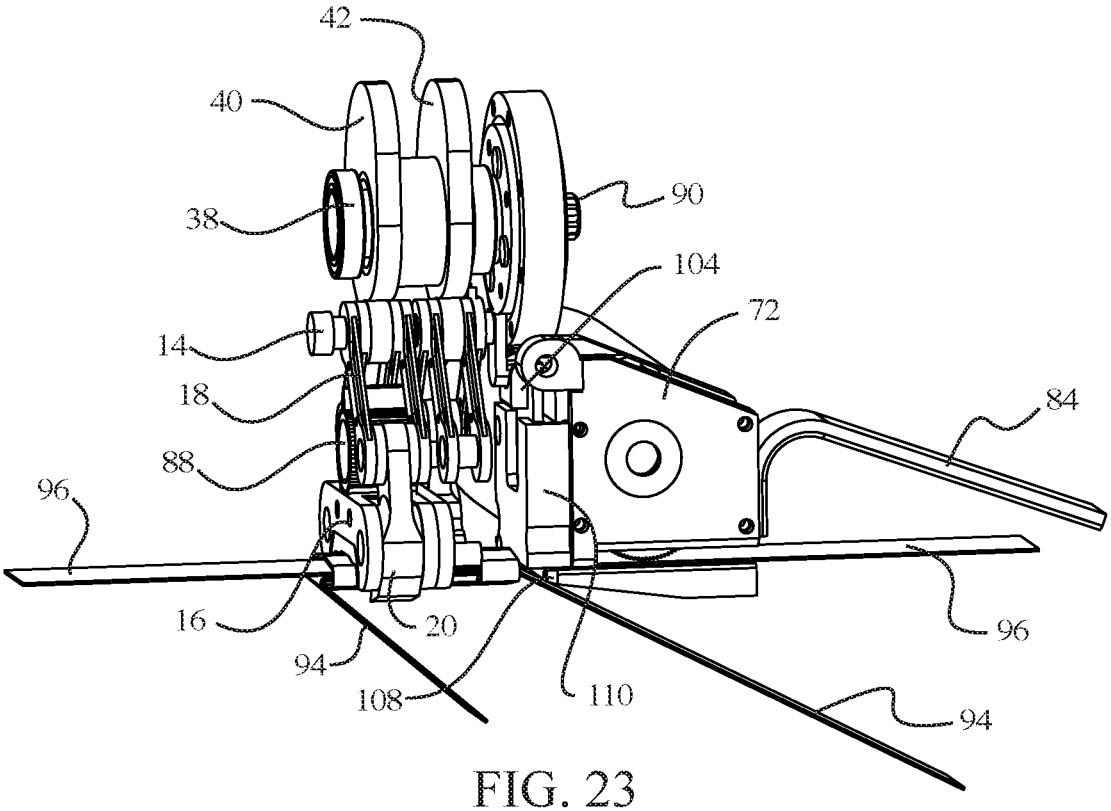
FIG. 23 is another perspective view of the strapping tensioning and sealing tool and the strapping of FIG. 4, wherein the entire housing of the sealing assembly has been removed, and a rear one of the crimping jaw members has been removed to more clearly illustrate the cutting blade of the sealing assembly in a disengaged, non-cutting position.
Figure 24:
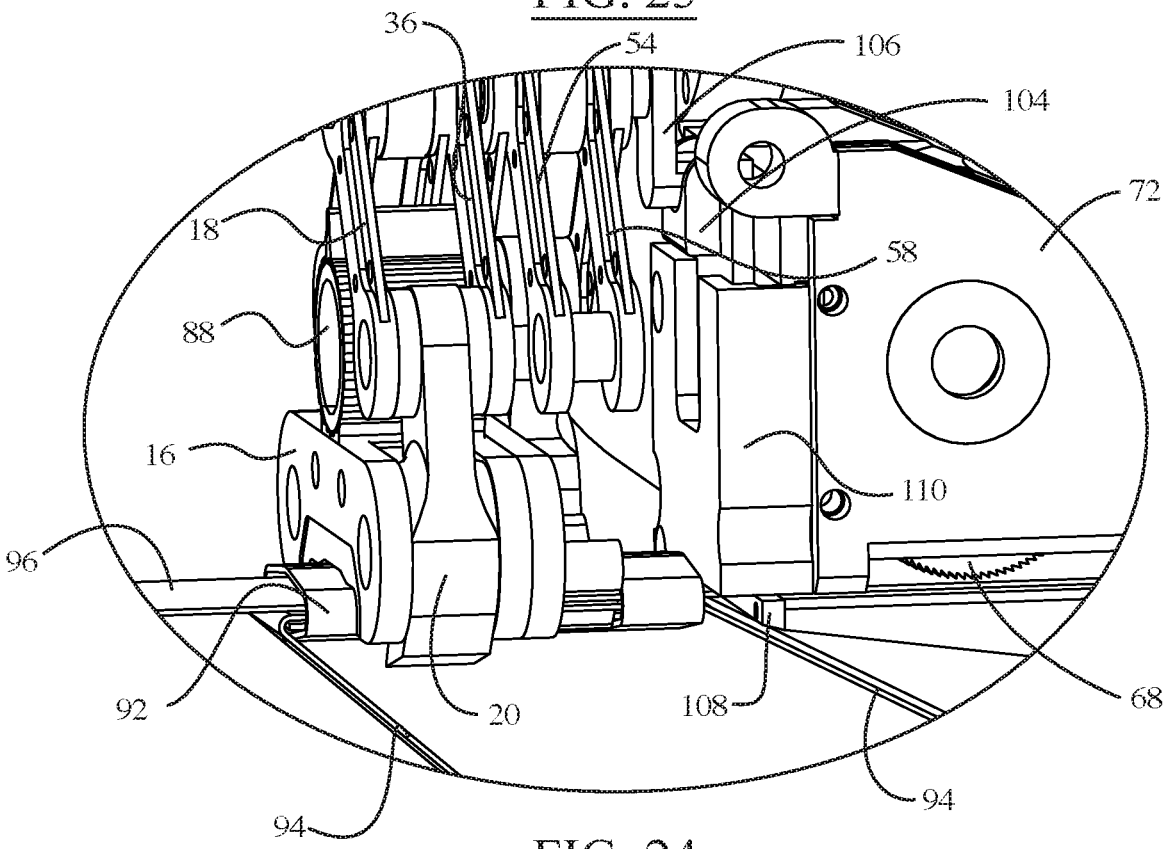
FIG. 24 is an enlarged perspective view of the lower portion of the sealing assembly illustrated in FIG. 23, wherein the cutting blade of the sealing assembly is disposed in a disengaged, non-cutting position.
Figure 25:
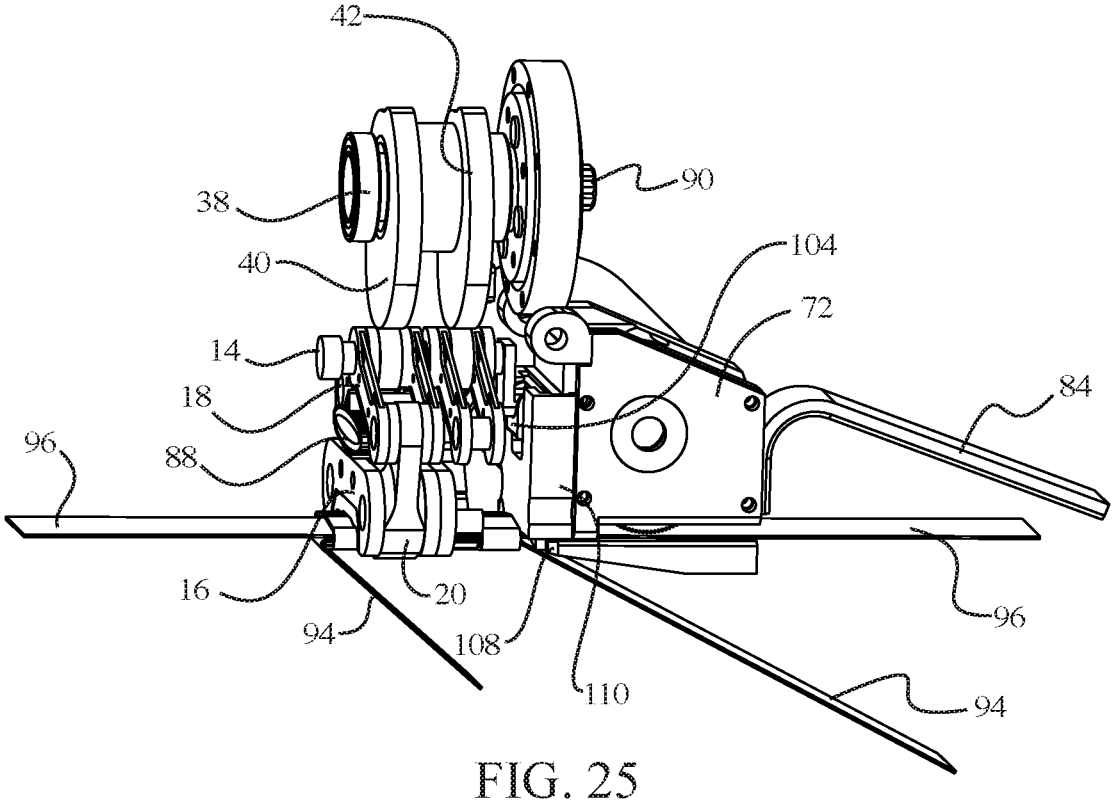
FIG. 25 is another perspective view of the strapping tensioning and sealing tool and the strapping of FIG. 4, wherein the entire housing of the sealing assembly has been removed, and a rear one of the crimping jaw members has been removed to more clearly illustrate the cutting blade of the sealing assembly in an engaged, cutting position.
Figure 26:
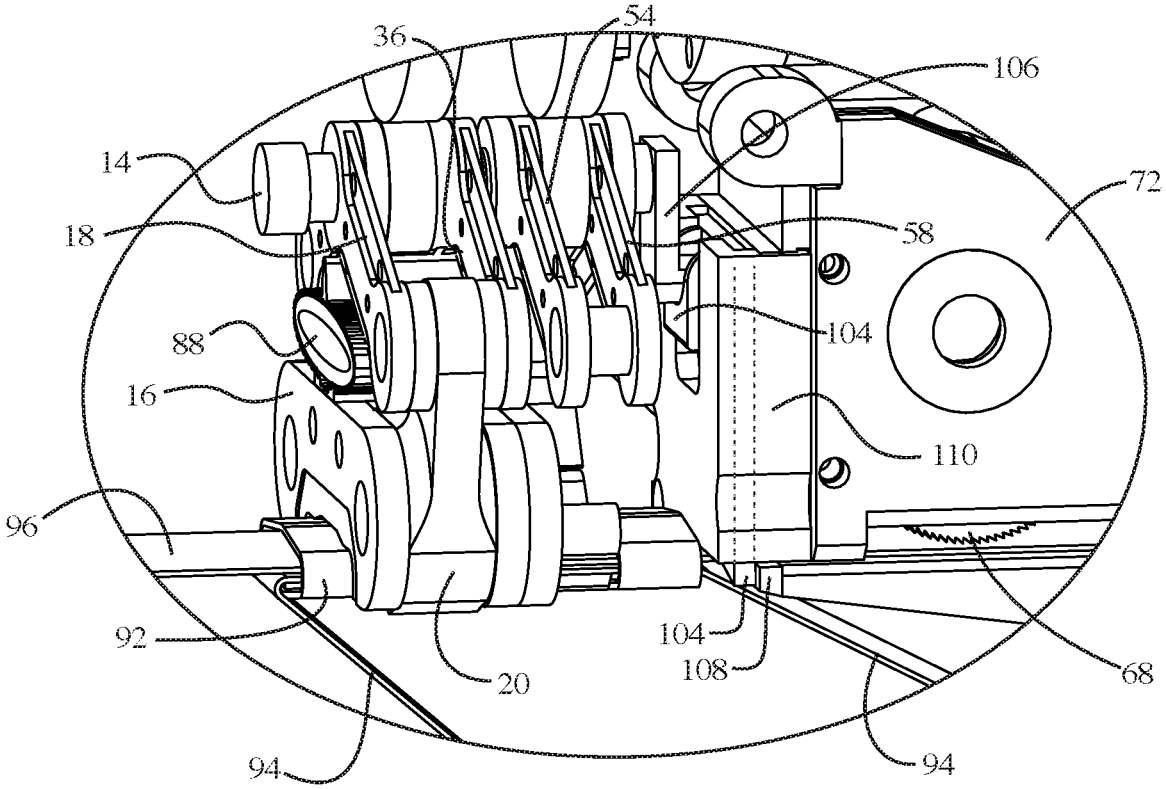
FIG. 26 is an enlarged perspective view of the lower portion of the sealing assembly illustrated in FIG. 25, wherein the cutting blade of the sealing assembly is disposed in an engaged, cutting position.
Figure 27:
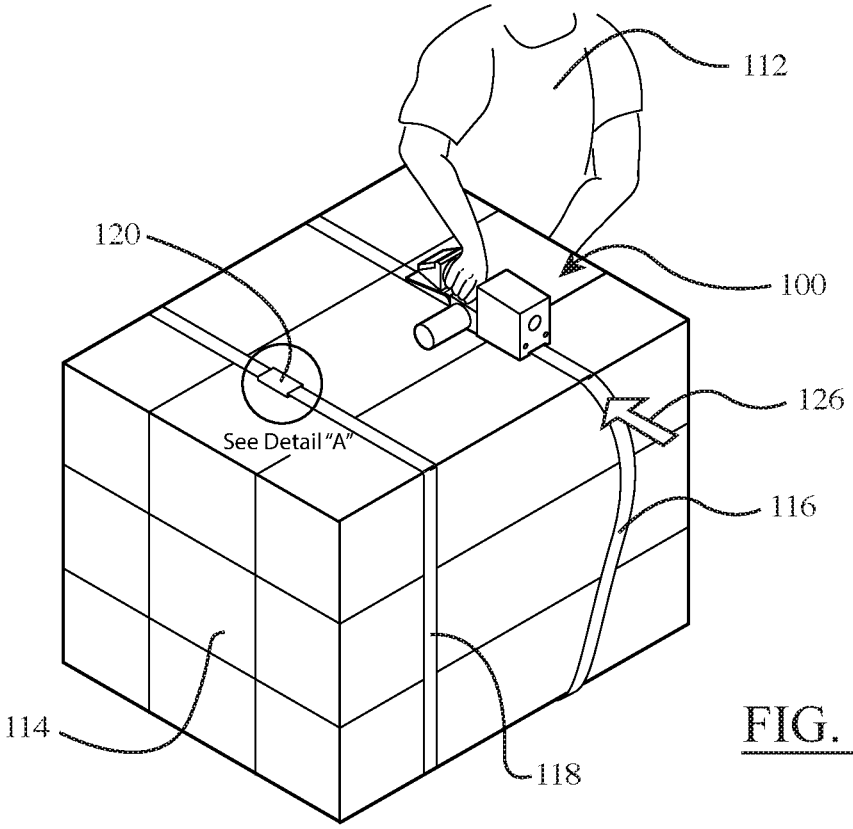
FIG. 27 is a perspective view of a user utilizing the strapping tensioning and sealing tool of FIG. 1 to secure strapping around a bundle of timber members.
Figure 28:
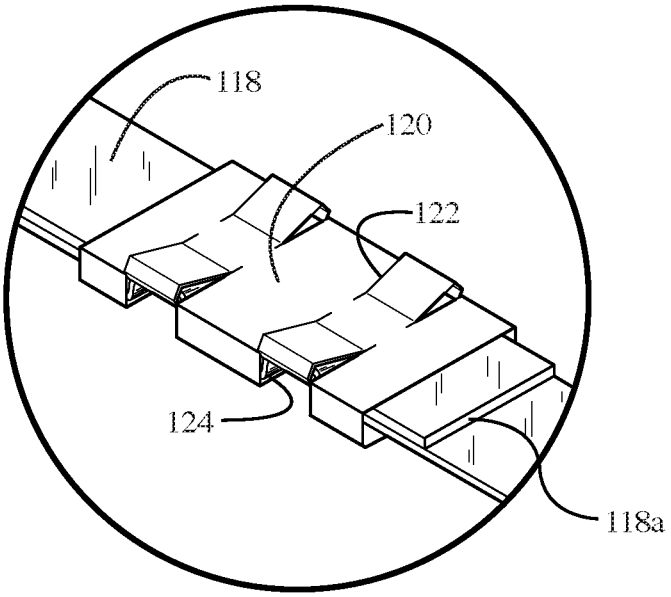
FIG. 28 is a perspective view of a strapping sealing member illustrating the crimped portions of the strapping sealing member formed by the sealing assembly of the strapping tensioning and sealing tool described herein.

An illustrative embodiment of the strapping tensioning and sealing tool is seen generally at 100 in FIGS. 1-4. Exploded side and perspective views of the assemblies that form the strapping tensioning and sealing tool 100 are depicted in FIGS. 9 and 10, respectively. Initially with reference to FIGS. 1 and 2, it can be seen that the strapping tensioning and sealing tool 100 generally comprises a tensioning assembly 11, the tensioning assembly 11 configured to apply tension to a piece of strapping; and a sealing assembly 10, the sealing assembly 10 comprising a plurality of cam members 40, 42, a plurality of crimping jaw members 20, 22, 48, 50, and a motive power source (i.e., sealing assembly motor 98—see FIG. 22), the plurality of cam members 40, 42 operatively coupling the plurality of crimping jaw members 20, 22, 48, 50 to the motive power source 98, and the plurality of crimping jaw members 20, 22, 48, 50 of the sealing assembly 10 configured to crimp a strapping sealing member 92 so as to secure the piece of strapping with strapping portions 94, 96 (see FIGS. 3 and 4) around a package or bundle of items. For example, as shown in FIG. 27, first and second straps 116, 118 may be secured around a package of wood timber members 114. Initially, as shown in FIG. 27, a user 112 utilizes the tensioning assembly 11 of the strapping tensioning and sealing tool 100 for tensioning the strap 116 (e.g., in the direction indicated by arrow 126). Then, after the strap is pulled tight using the tensioning assembly 11, the sealing assembly 10 of the strapping tensioning and sealing tool 100 is used to crimp the strapping seal members 120 so as to secure the end portions of the straps 116, 118 to one another. As shown in the detail view of FIG. 28, the free end 118*a* of the strap 118 is secured using the seal member 120 by forming crimped portions 122 in the strap 120 by utilizing the sealing assembly 10 of the strapping tensioning and sealing tool 100. In FIG. 28, it can be seen that the crimped portions 122 are bent upwardly so as to be separated from the non-crimped edges 124 of the seal member 120.

Figure 1:
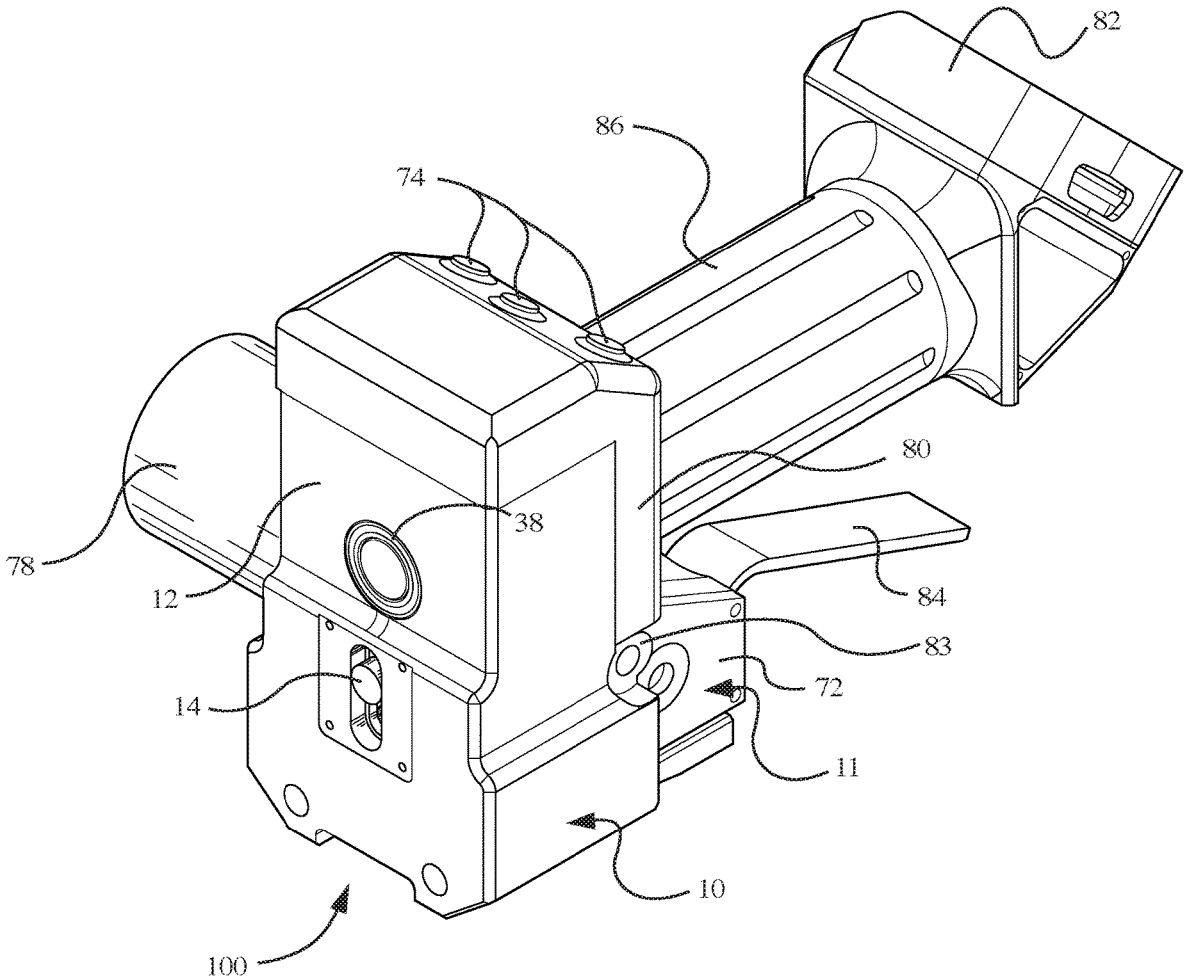
FIG. 1 is an assembled perspective view of a strapping tensioning and sealing tool, according to an embodiment of the invention.
Figure 7:
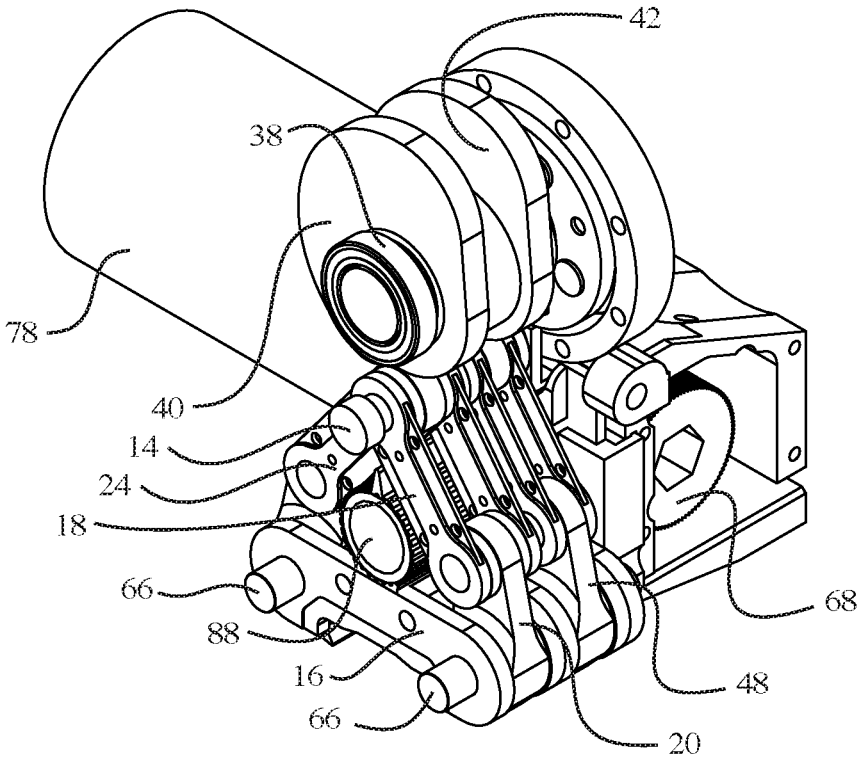
FIG. 7 is a perspective view illustrating the internal components of the tensioning and sealing assemblies of the strapping tensioning and sealing tool of FIG. 1.
Figure 8:
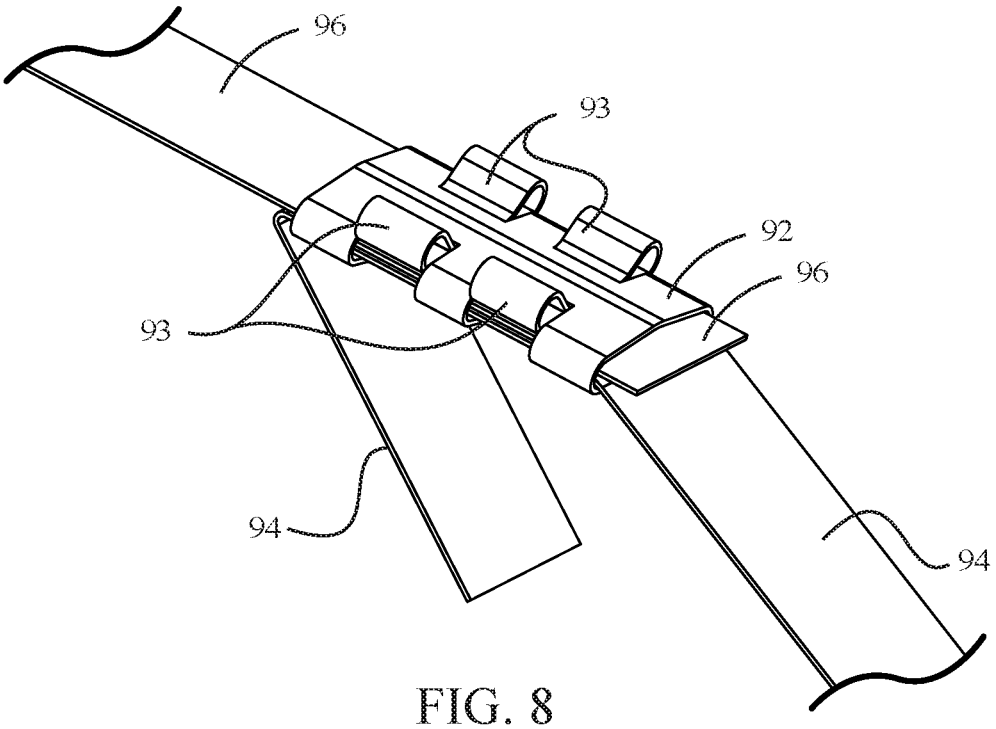
FIG. 8 is a perspective view of a piece of strapping with a crimped seal member secured thereto.

In the illustrative embodiment, with reference to FIGS. 7 and 10, it can be seen that the tensioning assembly 11 comprises a tensioning wheel 68 operatively coupled to an additional motive power source (i.e., an electric motor 76). In the illustrative embodiment, the dedicated electric motor 76 drives the tensioning wheel 68 so as to apply tension to the piece of strapping with lower strapping portion 94 and upper strapping portion 96 (see FIG. 8). As shown in the exploded view of FIG. 10, the tensioning assembly 11 of the strapping tensioning and sealing tool 100 further comprises a tensioning wheel bushing 70 that is enclosed within a tensioning assembly frame housing the tensioning wheel 68. The electric motor 76 of the tensioning assembly 11 is disposed within a motor housing 78. Also, as illustrated in FIGS. 1 and 10, the tensioning assembly 11 includes a cover plate 72 for concealing the tensioning wheel 68 within the tensioning assembly frame housing. With combined reference to FIGS. 3, 10, and 22, it can be seen that, in the illustrative embodiment, the electric motor 76 of the tensioning assembly 11 is disposed generally perpendicular to the electric motor 98 of the sealing assembly 10.

While separate electric motors 76, 98 are used for the tensioning assembly 11 and the sealing assembly 10 in the illustrative embodiment, it is to be understood that, in alternative embodiments, a single electric motor may be used to power both the tensioning assembly 11 and the sealing assembly 10. Also, in alternative embodiments, other types of motors may be used to power the tensioning assembly 11 and the sealing assembly 10, such as pneumatic motors and liquid fuel-based motors (e.g., gasoline-powered motors).

Figure 2:
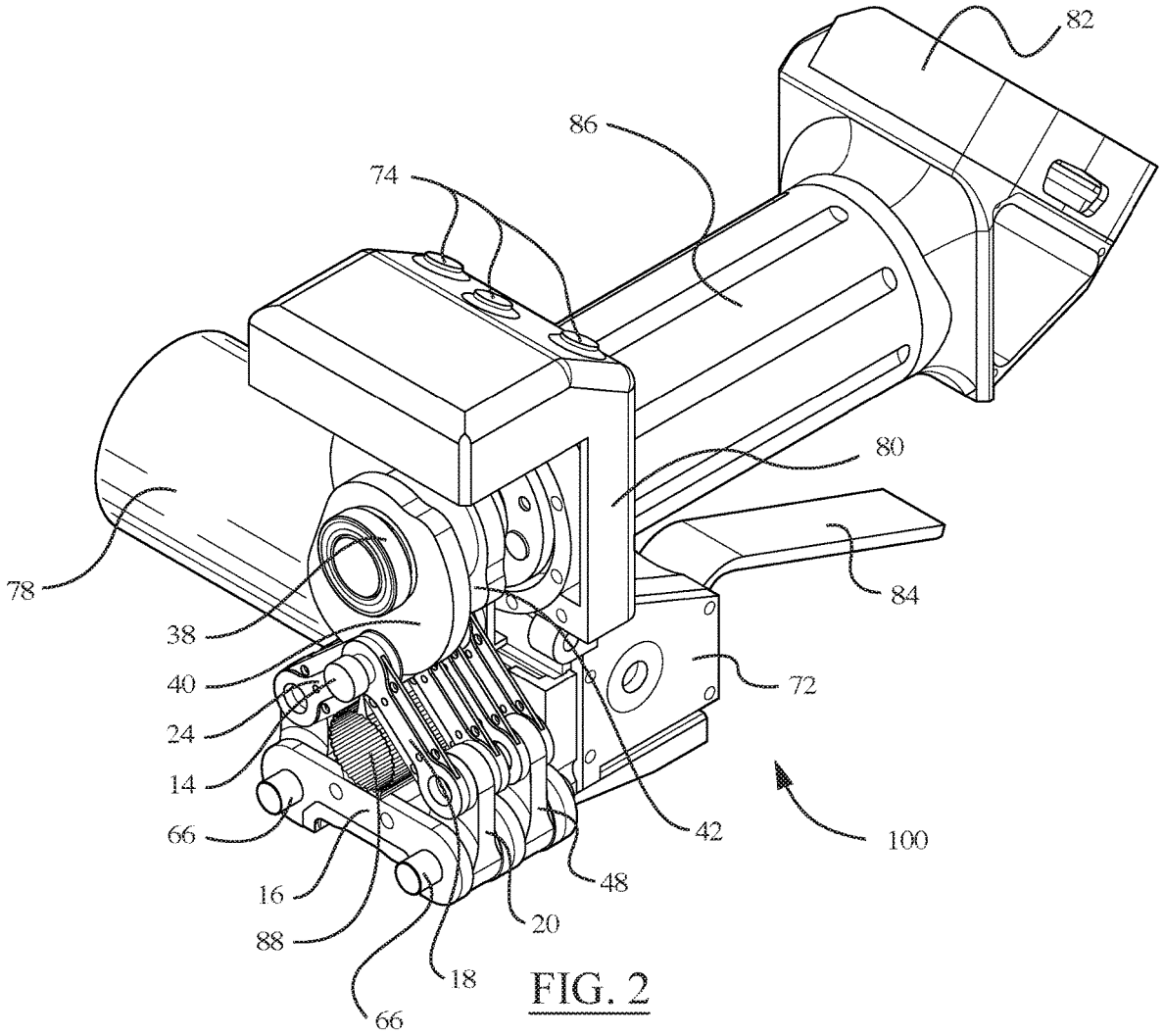
FIG. 2 is another perspective view of the strapping tensioning and sealing tool of FIG. 1, wherein a front cover of the sealing assembly has been removed.
Figure 5:
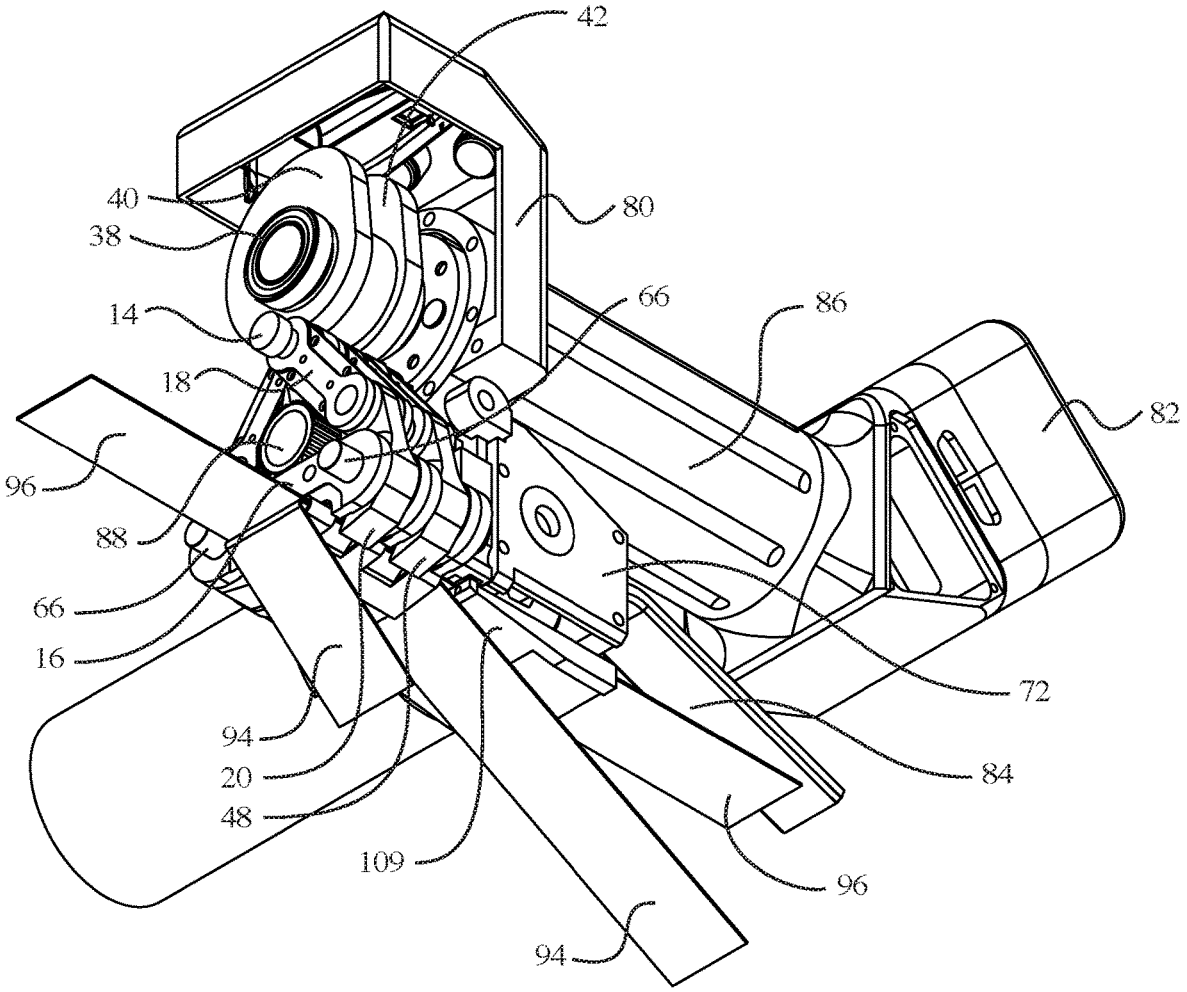
FIG. 5 is another bottom perspective view of the strapping tensioning and sealing tool and the strapping of FIG. 4, wherein the front cover of the sealing assembly has been removed.

Now, with reference primarily to FIGS. 7 and 10, it can be seen that the plurality of cam members 40, 42 of the sealing assembly 10 comprises a first cam member 40 and a second cam member 42, which are spaced apart from one another by a cam spacer member 44. In the illustrative embodiment, each of the cam members 40, 42 has a variable radii, continuous cam surface geometry. Also, in the illustrative embodiment, the plurality of crimping jaw members 20, 22, 48, 50 of the sealing assembly 10 comprises a front pair of crimping jaw members 20, 22 and a rear pair of crimping jaw members 48, 50. As shown in FIGS. 15-20, it can be seen that the front pair of crimping jaw members 20, 22 comprise respective crimping teeth 21, 23, and the rear pair of crimping jaw members 48, 50 comprise respective crimping teeth 49, 51, for forming the crimped portions 93 in the seal member 92 (see FIG. 8). In addition, as shown in FIGS. 10, 22, 23 and 25, each of the first and second cam members 40, 42 is operatively coupled to the sealing assembly motor 98 by means of the cam shaft 46, the cam driving gear 90, and motor connector member 102 (i.e., the cams 40, 42 are both simultaneously rotated by the cam shaft 46). As shown in FIGS. 1, 2, and 7, a cam bushing member 38 is provided on the front end of the cam shaft 46. The first cam member 40 is operatively coupled to the front pair of crimping jaw members 20, 22 so as to selectively activate the front pair of crimping jaw members 20, 22 (see FIGS. 7 and 23). The second cam member 42 is operatively coupled to the rear pair of crimping jaw members 48, 50 so as to selectively activate the rear pair of crimping jaw members 48, 50 (see FIGS. 5 and 7). Turning again to FIGS. 7 and 10, it can be seen that the front pair of crimping jaw members 20, 22 are operatively coupled to the first cam member 40 by a first plurality of crimp arm members 18, 24, 34, 36, while the rear pair of crimping jaw members 48, 50 are operatively coupled to the second cam member 42 by a second plurality of crimp arm members 52, 54, 56, 58.

Referring again to FIGS. 7 and 10, it can be seen that the upper ends of the crimp arm members 18, 24, 34, 36, 52, 54, 56, 58 are connected together by means of an arm pin member 14. The bottom ends of the crimping jaw members 20, 22, 48, 50 are connected together by means of connector members 16, 30, 32, 60, 62, which act as jaw spacer members, and long crimp arm connector shafts 66. As depicted in FIGS. 7 and 10, the upper ends of the crimping jaw members 20, 22, 48, 50 are pivotally coupled to crimp arm members 18, 24, 34, 36, 52, 54, 56, 58 by means of short crimp arm connector shafts 64. Lower washer members 26 are disposed between the crimping jaw members 20, 22, 48, 50 and the crimp arm members 18, 24, 34, 36, 52, 54, 56, 58, while the upper bushing members 28 engage the outer peripheries of the first and second cam members 40 so as to operatively couple the cam members 40, 42 to the crimp arm members 18, 24, 34, 36, 52, 54, 56, 58, which are attached to the crimping jaw members 20, 22, 48, 50.

Figure 3:
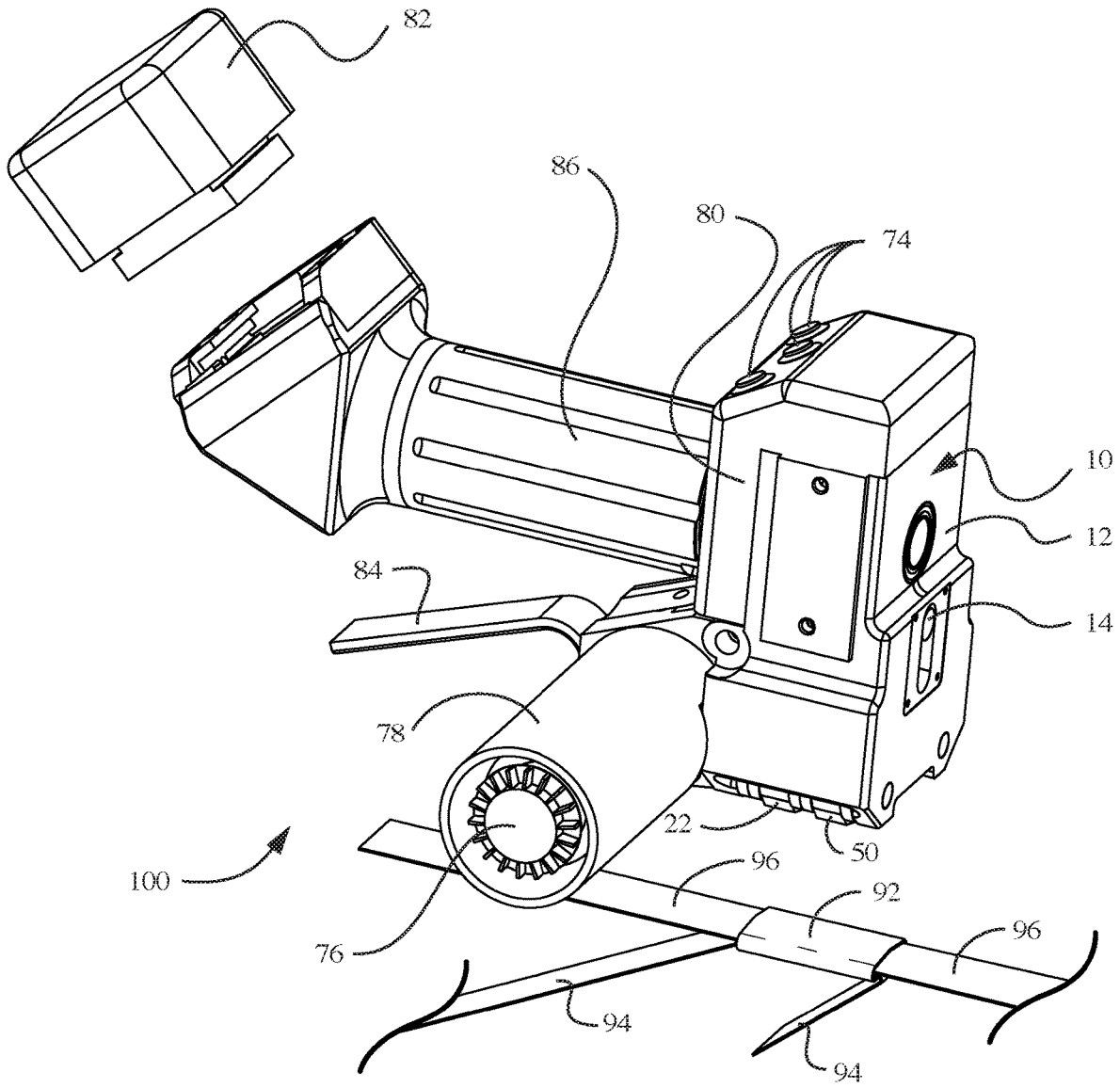
FIG. 3 is yet another perspective view of the strapping tensioning and sealing tool of FIG. 1, wherein a battery has been removed from the rest of the tool, and a motor cover of the tensioning assembly has been removed.

As best illustrated in FIGS. 1, 9, and 10, the internal components of the sealing assembly 10 are housed within the front housing or frame section 12 and a rear housing frame or frame section 80. Turning to FIGS. 1 and 3, it can be seen that that the strapping tensioning and sealing tool 100 is provided with a rechargeable battery 82 that is removable from its battery mount on the rear housing 80 so that the battery 82 can be easily charged. In the illustrative embodiment, the rechargeable battery 82 is capable of powering both the electric motor 76 of the tensioning assembly 11 and the electric motor 98 of the sealing assembly 10.

In the illustrative embodiment, as shown in FIGS. 2, 5, 7, 10-12, and 15-20, the sealing assembly 10 of the strapping tensioning and sealing tool 100 further comprises at least one resilient tubular member 88, which is elastically deformable (see FIGS. 11, 12, and 17-20) and acts as a return spring for the crimp arm members 18, 24, 34, 36, 52, 54, 56, 58. The resilient tubular member 88 is configured to bias the crimp arm members 18, 24, 34, 36, 52, 54, 56, 58 in an upward position (i.e., the FIG. 2 position) such that the crimp arm members 18, 24, 34, 36, 52, 54, 56, 58 are continually operatively coupled to the first and second cam members 40, 42 by means of an arm pin subassembly with arm pin member 14 and upper bushing members 28.

Figure 15:
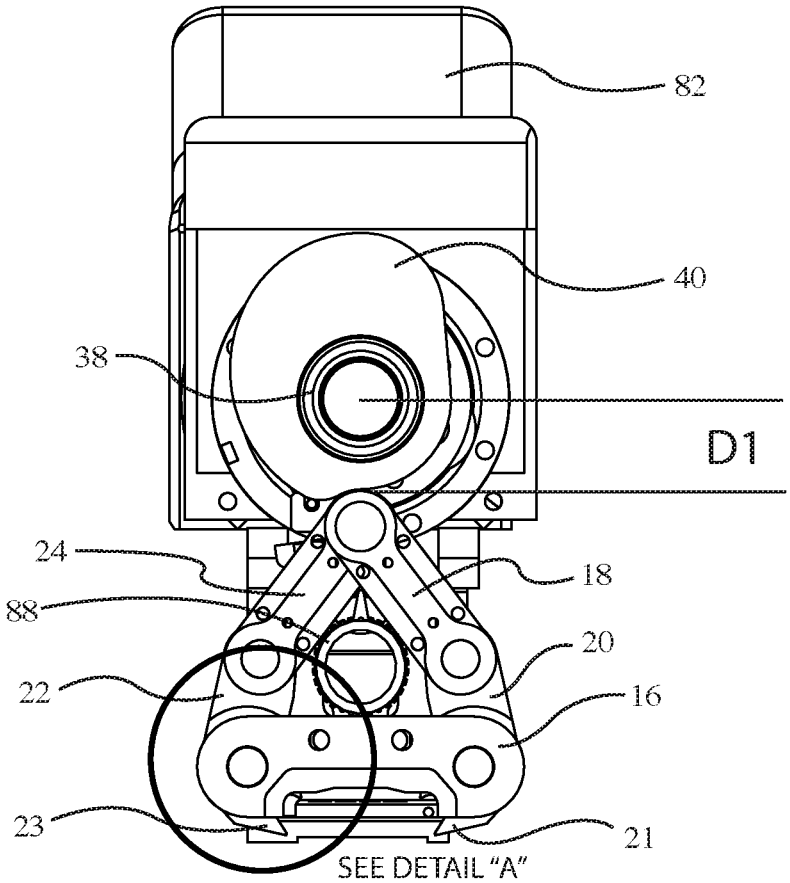
FIG. 15 is a front elevational view of the internal components of the sealing assembly of the strapping tensioning and sealing tool of FIG. 1, wherein the distance between the center of the cam shaft and the surface of the first cam member is shown when the front and rear pairs of crimping jaw members are both in uncrimped positions.
Figure 16:
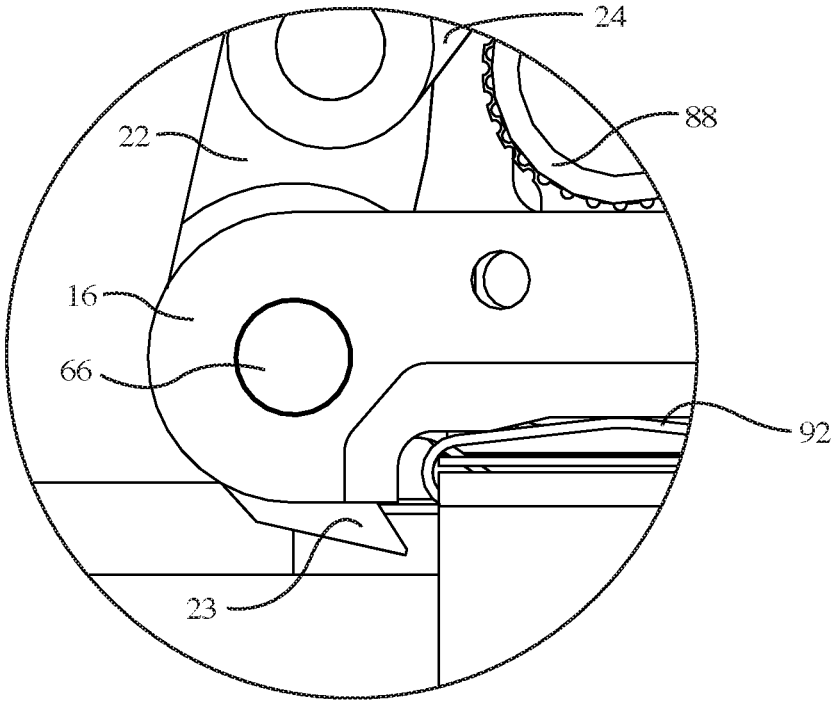
FIG. 16 is an enlarged front view of one of the front pair of crimping jaw members and a portion of a strapping seal member (Detail "A"), wherein the crimping jaw member is disposed in an uncrimped position.
Figure 17:
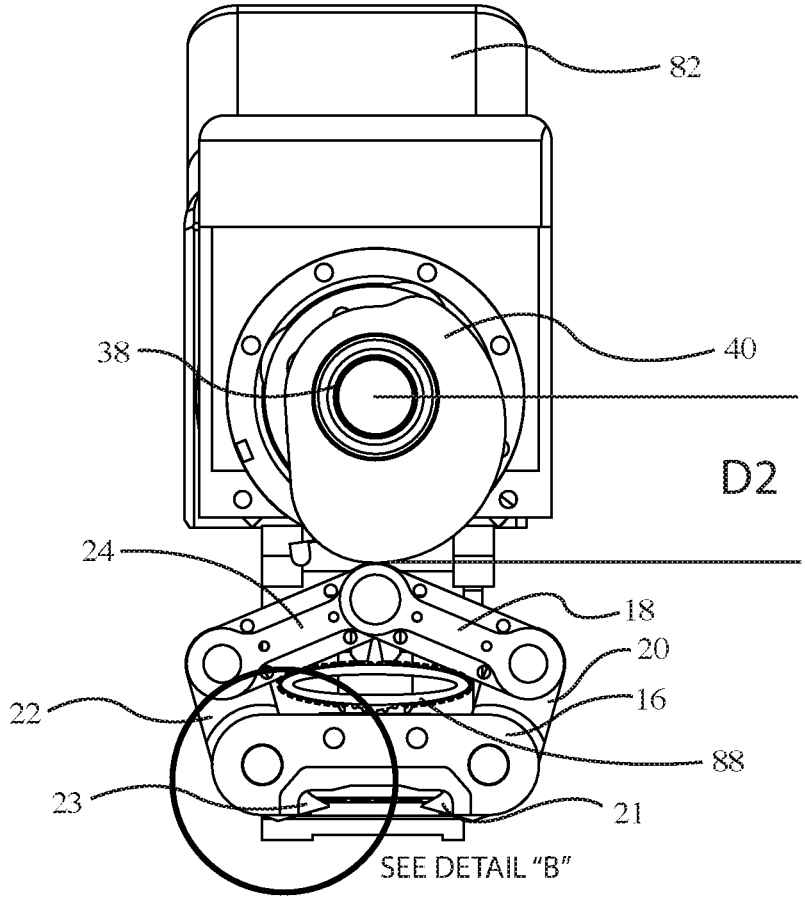
FIG. 17 is a front elevational view of the internal components of the sealing assembly of the strapping tensioning and sealing tool of FIG. 1, wherein the distance between the center of the cam shaft and the surface of the first cam member is shown when the front and rear pairs of crimping jaw members are both in crimped positions.
Figure 18:
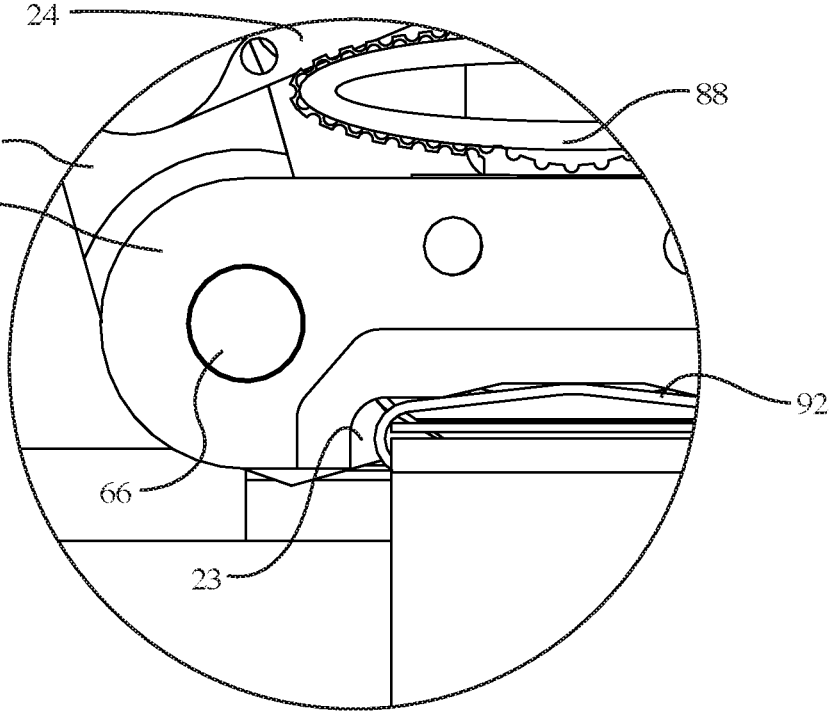
FIG. 18 is an enlarged front view of one of the front pair of crimping jaw members and a portion of a strapping seal member (Detail "B"), wherein the crimping jaw member is disposed in a crimped position.
Figure 19:
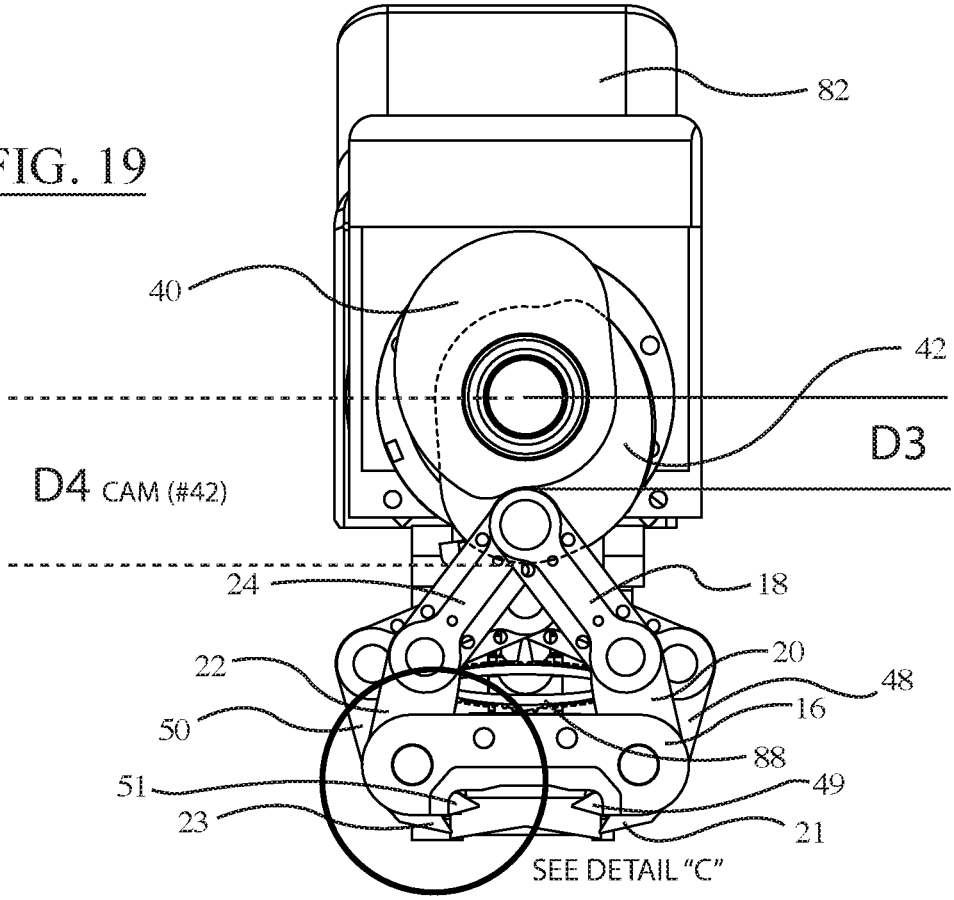
FIG. 19 is a front elevational view of the internal components of the sealing assembly of the strapping tensioning and sealing tool of FIG. 1, wherein the distance between the center of the cam shaft and the surface of the first cam member is shown when the front pair of crimping jaw members are in an uncrimped position and the rear pair of crimping jaw members are in an crimped position.
Figure 20:
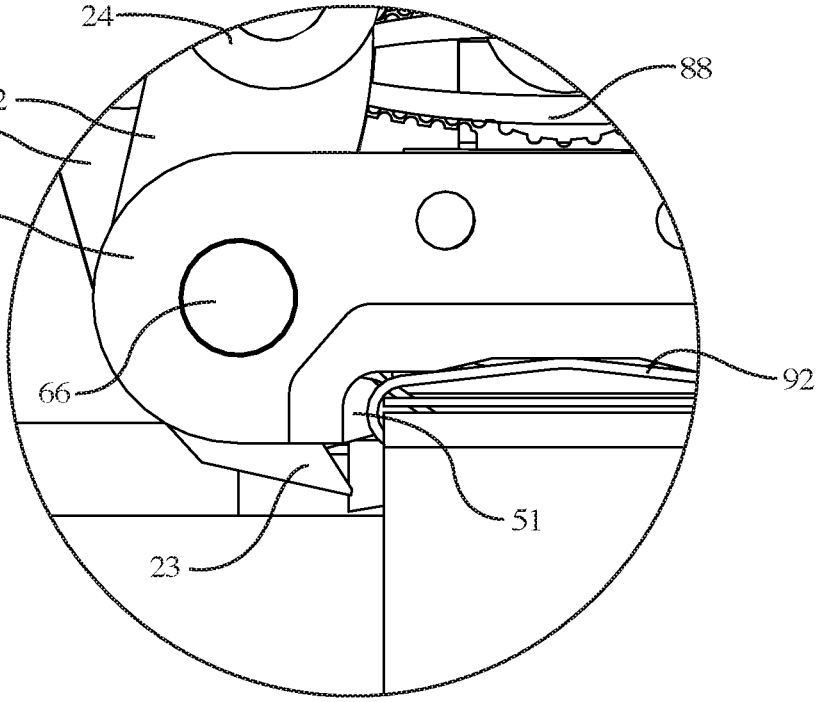
FIG. 20 is an enlarged front view of one of the front pair of crimping jaw members, one of the rear pair of crimping jaw members, and a portion of a strapping seal member (Detail "C"), wherein the front crimping jaw member is disposed in an uncrimped position and the rear crimping jaw member is disposed in a crimped position.
Figure 21:
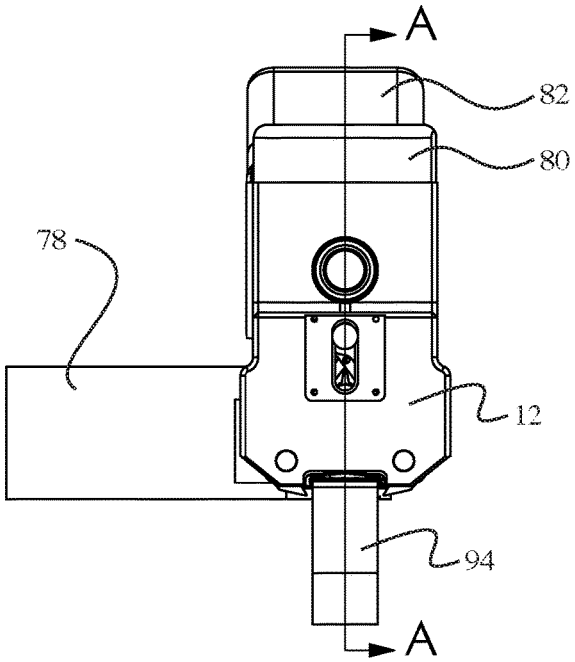
FIG. 21 is a front elevational view of the strapping tensioning and sealing tool and the strapping of FIG. 4, wherein cutting-plane line A-A is shown disposed thereon.

Different operational positions of the first and second cam members 40, 42 are illustrated in FIGS. 15-20. In FIGS. 15 and 16, both the front and rear pairs of crimping jaw members 20, 22, 48, 50 are in their uncrimped positions, and the distance D1 defines the distance between the center of the cam shaft 46 and the location where the cam surfaces contact the hinge point of the crimp arm members 18, 24, 34, 36, 52, 54, 56, 58. In FIGS. 17 and 18, both the front and rear pairs of crimping jaw members 20, 22, 48, 50 are in their crimped positions, and the distance D2 defines the distance between the center of the cam shaft 46 and the location where the cam surfaces contact the hinge point of the crimp arm members 18, 24, 34, 36, 52, 54, 56, 58. In FIGS. 15-16 and 17-18, the first and second cam members 40, 42 rotate in sync with one another (i.e., cam surface portions are aligned). Finally, in FIGS. 19 and 20, the front pair of crimping jaw members 20, 22 are in an uncrimped position and the rear pair of crimping jaw members 48, 50 are in an crimped position. The distance D3 defines the distance between the center of the cam shaft 46 and the location where the cam surface of the first cam member 40 contacts the hinge point of the crimp arm members 18, 24, 34, 36, and the distance D4 defines the distance between the center of the cam shaft 46 and the location where the cam surface of the second cam member 42 contacts the hinge point of the crimp arm members 52, 54, 56, 58. In FIGS. 19 and 20, the first and second cam members 40, 42 rotate out of sync with one another (i.e., cam surface portions of the first and second cam members 40, 42 are not aligned with one another).

In the illustrative embodiment, the strapping tool 100 further comprises a control system operatively coupled to the electric motor 76 of the tensioning assembly 11 and the electric motor 98 of the sealing assembly 10. The control system of the strapping tool 100 may be configured to measure motor load by means of amperage integration for assessing whether the strapping seal member is correctly applied (i.e., for seal quality assessment). In the illustrative embodiment, the control system of the strapping tool 100 is configured to assess whether the strapping seal member 92, 120 is correctly applied by determining if the motor load is above or below predetermined upper and lower limit threshold values. When the control system determines that the motor load is between the predetermined upper and lower limit threshold values, the control system concludes that the strapping seal member 92, 120 is correctly applied. Conversely, when the control system determines that the motor load is above the predetermined upper threshold value or below the predetermined lower threshold value, the control system concludes that the strapping seal member 92, 120 is not correctly applied (i.e., an improper seal). Also, in the illustrative embodiment, the control system may be configured to measure motor load by means of amperage integration for assessing the tension applied to the piece of strapping 94, 96, 116, and 118.

As shown in FIGS. 1-3, the control system of the strapping tool 100 further comprises a plurality of control buttons 74 (e.g., three (3) control buttons). At least a first one of the control buttons may be configured to control the operation of the tensioning assembly 11, while at least a second one of the control buttons 74 may be configured to control the operation of the sealing assembly 10. In the illustrative embodiment, the control system of the strapping tool 100 further comprises a microcontroller configured to control one or more hardware timers, one or more microcontroller timers, or one or more other timers so as to operate a plurality of timer circuits. The microcontroller is used in the central processing for the control of the strapping tool 100. In the illustrative embodiment, a timer array is set up to use the hardware timer to run a variety of timer circuits. For example, in the auto cycle, a timer is used to lockout the shutoff control for the motor starting inrush. When the inrush is past, the microcontroller looks for sufficient current to establish the tension setting. The same lockout system is used on the sealing or bonding system with a limit switch shutting down the sealing or bonding system motor as a complete cycle.

In the illustrative embodiment, the motive power source for the strapping tool 100 comprises a battery-powered drill that includes a drill control board (i.e., the electric motor 98 is a drill motor controlled by a drill control board). In the illustrative embodiment, the strapping tool 100 further comprises an additional control board operatively coupled to the drill control board. The additional control board is configured to control the battery-powered drill via the drill control board so as to enable the battery-powered drill to perform strapping functions. The additional control board may also be configured to receive feedback information from the drill control board of the battery-powered drill. Advantageously, the use of a battery-powered drill that includes a drill control board, which is produced in large volumes, for the motive power source of the strapping tool 100 is a manner in which the production costs of the strapping tool 100 described herein can be significantly reduced. The use of the additional control board enables the battery-powered drill that includes a drill control board to perform specialized strapping functions.

In one or more embodiments, the motive power system used for the strapping tool 100 is a modified standard commercial drill motor and controls used with the standard battery of the drill. An inventive proprietary control is used to operate the motor drive of the drill. In the illustrative embodiment, the motor drive is connected to the battery (i.e., battery 82) and two brushless direct current (DC) motors (i.e. motors 76, 98). Internal to the motor are six transistors and an internal motor control with shunts to control current to the motor windings. The inventive proprietary control supplies the input signals to the internal motor controls. The main signals are the run, direction, and impulse or full speed inputs. An additional Hall Effect current measurement is used for decisions on the tension completion cycle. A limit switch is used for the measurement of the sealing cycle completion.

In the illustrative embodiment, as shown in FIG. 1, the internal components of the battery-powered drill are disposed within a customized housing 12, 80 that is particularly configured to accommodate the tensioning assembly and the sealing assembly of the strapping tool 100. That is, in the illustrative embodiment, the battery-powered drill and the drill control board are removed from their conventional housing, and placed in the customized housing 12, 80. Advantageously, removing the battery-powered drill and the drill control board from their conventional housing has one or more of the following benefits: (i) the drill power is able to be obtained using a smaller footprint, (ii) the conventional housing of the drill does not interfere with the specialized functions of the strapping tool 100 (i.e., the conventional housing may have projections that could interfere with the functionality of the strapping tool 100, and (iii) the customized housing 12, 80 allows for improved cooling of the internal components of the battery-powered drill.

Figure 6:
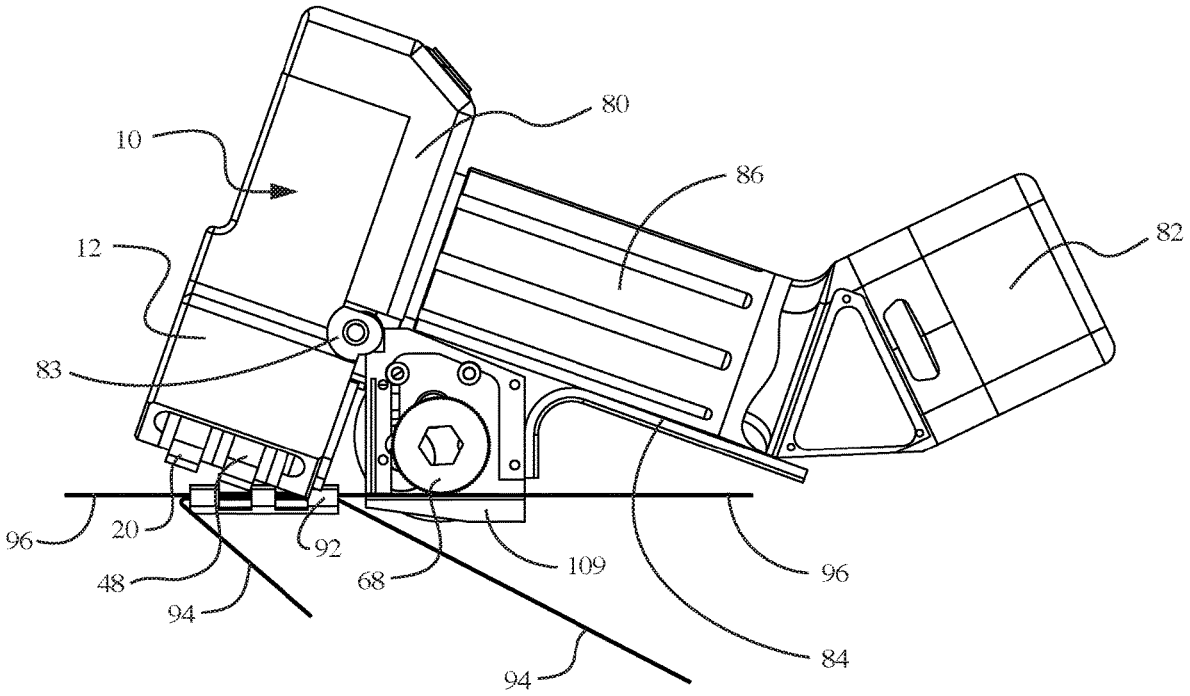
FIG. 6 is a side elevational view of the strapping tensioning and sealing tool and the strapping of FIG. 4, wherein the tool is illustrated in tipped-back position in which the handle of the tool is resting on the L-shaped support member.

Turning to FIGS. 1 and 6, it can be seen that the tensioning assembly 11 of the strapping tool 100 is connected to the sealing assembly 10 by means of a hinge member 83 such that the sealing assembly 10 is configured to rotate relative to the tensioning assembly 11. As shown in FIG. 6, the strapping tool 100 is illustrated in its tipped-back position in which the handle 86 of the tool 100 is resting on the L-shaped support member 84, which limits the maximum amount of clockwise rotation of the tool 100. The tipped-back position of the strapping tool 100 illustrated in FIG. 6 allows the crimping jaw members 20, 22, 48, 50 to be raised so that the strapping pass line is cleared of the jaw obstruction and the strapping can be loaded into the strapping tool 100.

Figure 4:
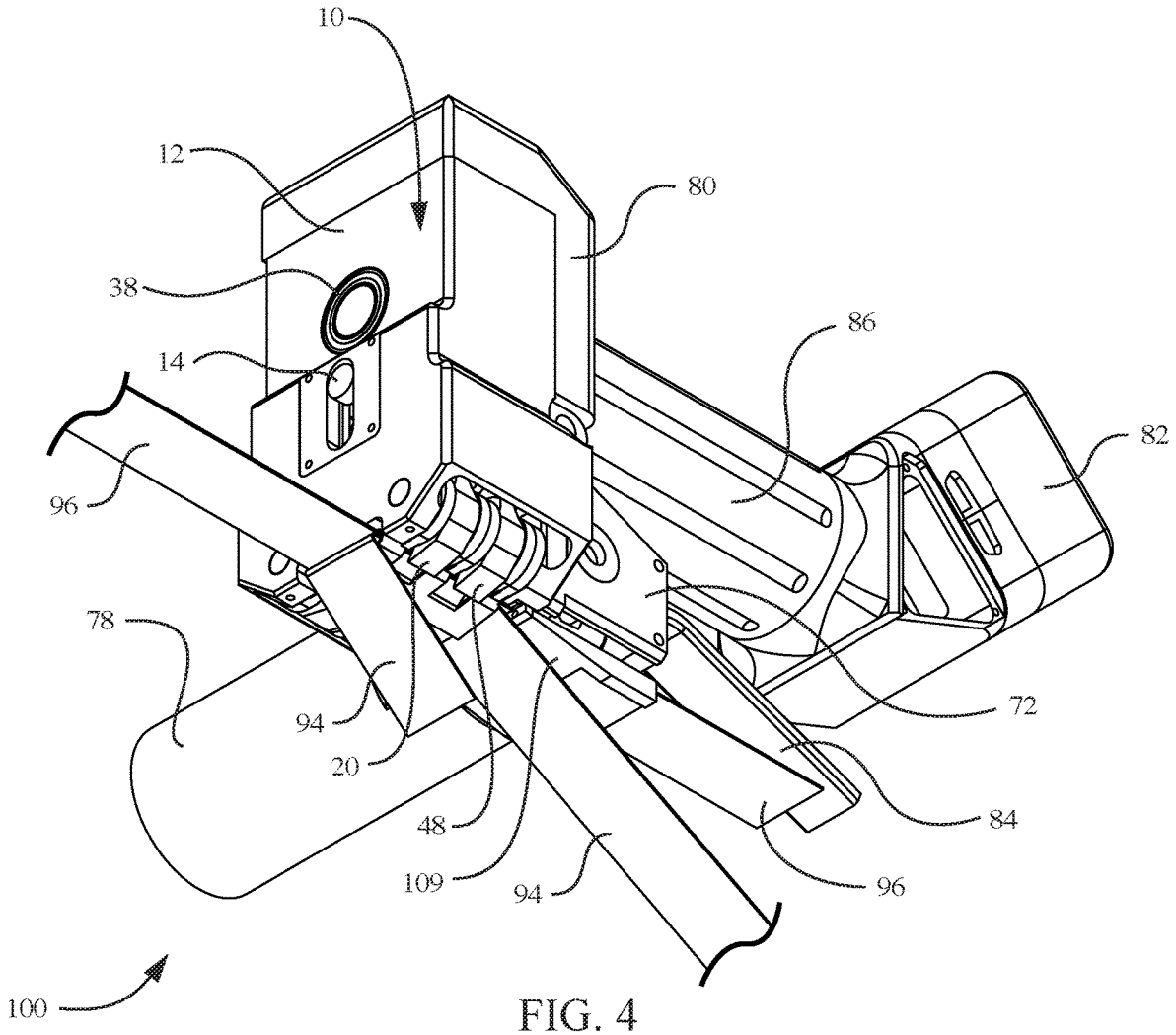
FIG. 4 is a bottom perspective view of the strapping tensioning and sealing tool of FIG. 1, wherein a piece of strapping is illustrated in conjunction with the tool.

Turning to FIGS. 23-26, it can be seen that, in the illustrative embodiment, the sealing assembly 10 of the strapping tool 100 further comprises a cutting blade 104 for cutting the piece of strapping 94, 96, 116, and 118. The second cam member 42 of the sealing assembly 10 is operatively coupled to the cutting blade 104 by means of a cutting blade linkage member 106 (see FIGS. 24 and 26) that engages the drive assembly of the rear pair of crimping jaw members 48, 50. As such, when the second cam member 42 reaches a predetermined rotational position, the cutting blade linkage member 106 drives the cutting blade 104 downwardly so as to slice through the piece of strapping (i.e., the cutting blade 104 is slidably displaced in a downward direction by the cutting blade linkage member 106 so as to assume its engaged, cutting position. As shown in FIGS. 23-26, the cutting blade 104 is enclosed within a cutting blade housing 110, and is disposed adjacent to the cutting edge member 108 when the cutting blade 104 is displaced into its downward position. Referring to FIGS. 4, 5, and 23-26, it can be seen that the cutting edge member 108 is disposed adjacent to a wedge-shaped bottom plate member 109 of the strapping tool 100, which helps to separate the upper and lower portions of the piece of strapping from one another so that the lower piece of strapping is not inadvertently cut. As best shown in FIG. 4, the bottom surface of the wedge-shaped bottom plate member 109 has a groove formed therein with a width that is approximately equal to the strapping (e.g., to receive the lower portion of the strapping therein).

Now, referring to FIGS. 4-8, 27, and 28, the tensioning and sealing operation of the strapping tensioning and sealing tool 100 of the illustrative embodiment will now be described. Initially, a piece of strapping 116, 118 (i.e., a piece of steel strapping) of one of a number of sizes is looped around the package or bundle 114 that requires the restraint (see e.g., FIG. 27). Then, the user threads a first free end of the strapping through a seal member or banding clip 120. After which, the user bends the first free end of the strapping back so that it is not able to be pulled out of the seal member 120. Next, the user inserts the second free end of the strapping through the seal member 120 so that a continuous loop is formed around the bundle 114. Then, the strapping tensioning and sealing tool 100 is opened (see FIG. 6), and the strapping and seal member 120 is inserted into the tool 100 (see FIG. 6). The strapping is inserted into the slot of the tool 100 where the tensioning wheel 68 grabs the strapping (see FIG. 6). Then, the tool 100 is closed (see FIG. 4), and the first one of the control buttons 74 is depressed by the user so that the tensioning wheel 68 applies tension to the strapping. Finally, once the strapping has been pulled tight by the tensioning assembly 11 of the tool 100, the second one of the control buttons 74 is depressed by the user so that the crimping teeth 21, 23, 49, 51 of the crimping jaw members 20, 22, 48, 50 crimps the metal seal member or banding clip (see FIGS. 8 and 28) and the cutting blade 104 cuts the excess portion of the strap from the strapping around the bundle 114. The crimped seal member ensures that the strapping around the bundle 114 does not release its tension.

It is readily apparent that the aforedescribed strapping tensioning and sealing tool 100 offers numerous advantages. First, the strapping tool 100 is sufficiently lightweight so as to enable a single person to use the tool for multiple strapping operations on steel strapping (e.g., for both tensioning and sealing). Secondly, the strapping tool 100 is sufficiently lightweight so as to obviate the need for the use of a counterbalance when using the tool. Finally, the strapping tool 100 utilizes a preassembled motive power source and associated control board (i.e., a battery-powered drill and drill control board) in order to reduce the number of specialized custom components of the tool, thereby reducing its overall cost.

Although the invention has been shown and described with respect to a certain embodiment or embodiments, it is apparent that this invention can be embodied in many different forms and that many other modifications and variations are possible without departing from the spirit and scope of this invention While exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A strapping tool, comprising:

at least one motive power source;

a tensioning assembly, said tensioning assembly comprising a tensioning member operatively coupled to said at least one motive power source, said at least one motive power source driving said tensioning member so as to apply tension to a piece of strapping; and a sealing assembly, said sealing assembly comprising at least one cam member and at least one crimping jaw member said at least one cam member operatively coupling said at least one crimping jaw member to said at least one motive power source, and said at least one crimping jaw member of said sealing assembly configured to crimp a strapping seal member so as to secure said piece of strapping around a package or bundle of items.

2. The strapping tool according to claim 1, wherein said tensioning member of said tensioning assembly is a tensioning wheel.

3. The strapping tool according to claim 1, wherein said at least one cam member of said sealing assembly comprises a first cam member and a second cam member and said at least one crimping jaw member of said sealing assembly comprises a first pair of crimping jaw members and a second pair of crimping jaw members, each of said first and second cam members being operatively coupled to said at least one motive power source, said first cam member being operatively coupled to said first pair of crimping jaw members so as to selectively activate said first pair of crimping jaw members, and said second cam member being operatively coupled to said second pair of crimping jaw members so as to selectively activate said second pair of crimping jaw members.

4. The strapping tool according to claim 3, wherein said first pair of crimping jaw members are operatively coupled to said first cam member by a first plurality of crimp arm members, and said second pair of crimping jaw members are operatively coupled to said second cam member by a second plurality of crimp arm members.

5. The strapping tool according to claim 4, wherein said sealing assembly further comprises a resilient tubular member, said resilient tubular member configured to bias said first and second pluralities of crimp arm members in an upward position such that said first and second pluralities of crimp arm members are continually operatively coupled to said first and second cam members by means of an arm pin subassembly.

6. The strapping tool according to claim 3, wherein said first cam member is independent from said second cam member.

7. The strapping tool according to claim 6, wherein said at least one motive power source comprises one of: (i) a pneumatic motor, (ii) a battery-powered electric motor, and (iii) a liquid fuel-based motor.

8. The strapping tool according to claim 1, wherein said strapping tool does not have a counterbalance for a user to operate said strapping tool.

9. The strapping tool according to claim 1, wherein said at least one motive power source of said sealing assembly comprises an electric motor, and wherein said strapping tool further comprises a control system operatively coupled to said electric motor of said sealing assembly, said control system configured to measure motor load by means of amperage integration for assessing whether said strapping seal member is correctly applied.

10. The strapping tool according to claim 9, wherein said control system is configured to assess whether said strapping seal member is correctly applied by determining if said motor load is above or below predetermined upper and lower limit threshold values;

when said control system determines that said motor load is between said predetermined upper and lower limit threshold values, said control system concludes that said strapping seal member is correctly applied; and conversely, when said control system determines that said motor load is above said predetermined upper threshold value or below said predetermined lower threshold value, said control system concludes that said strapping seal member is not correctly applied.

11. The strapping tool according to claim 9, wherein said control system further comprises a plurality of control buttons, a first one of said control buttons configured to control the operation of said tensioning assembly and a second one of said control buttons configured to control the operation of said sealing assembly.

12. The strapping tool according to claim 9, wherein said control system further comprises a microcontroller configured to control one or more hardware timers, one or more microcontroller timers, or one or more other timers so as to operate a plurality of timer circuits.

13. The strapping tool according to claim 1, wherein said at least one motive power source comprises a battery-powered drill that includes a drill control board, wherein said strapping tool further comprises an additional control board operatively coupled to said drill control board, said additional control board configured to control said battery-powered drill via said drill control board so as to enable said battery-powered drill to perform strapping functions; and wherein the internal components of said battery-powered drill are disposed within a customized housing that is particularly configured to accommodate said tensioning assembly and said sealing assembly.

14. The strapping tool according to claim 13, wherein said additional control board is further configured to receive feedback information from said drill control board of said battery-powered drill.

15. The strapping tool according to claim 1, wherein said tensioning assembly is connected to said sealing assembly by means of a hinge member such that said sealing assembly is configured to rotate relative to said tensioning assembly.

16. The strapping tool according to claim 1, wherein said sealing assembly further comprises a cutting blade for cutting said piece of strapping, and said at least one cam member of said sealing assembly comprises a first cam member and a second cam member, said cutting blade being operatively coupled to said second cam member by means of a cutting blade linkage member.

17. The strapping tool according to claim 1, wherein said at least one motive power source comprises a first battery-powered electric motor and a second battery-powered electric motor, said first battery-powered electric motor powering said tensioning assembly, and said second battery-powered electric motor powering said sealing assembly.

18. The strapping tool according to claim 17, wherein said first battery-powered electric motor is disposed generally perpendicular to said second battery-powered electric motor.

19. The strapping tool according to claim 1, wherein said tensioning member of said tensioning assembly is a tensioning wheel and said at least one motive power source is an electric motor, and wherein said strapping tool further comprises a control system operatively coupled to said electric motor, said control system configured to measure motor load by means of amperage integration for assessing said tension applied to said piece of strapping.

20. A strapping tool, comprising:

a battery-powered motor;

a tensioning assembly, said tensioning assembly comprising a tensioning member operatively coupled to said battery-powered motor, said battery-powered motor driving said tensioning member so as to apply tension to a piece of strapping; and a sealing assembly, said sealing assembly comprising at least one cam member and at least one crimping jaw member, said at least one cam member operatively coupling said at least one crimping jaw member to said battery-powered motor, and said at least one crimping jaw member of said sealing assembly configured to crimp a strapping seal member so as to secure said piece of strapping around a package or bundle of items.

* * * * *